US007842446B2

(12) United States Patent
Yanase et al.

(10) Patent No.: US 7,842,446 B2
(45) Date of Patent: Nov. 30, 2010

(54) TONER

(75) Inventors: Eriko Yanase, Mishima (JP); Michihisa Magome, Shizuoka-ken (JP); Takashi Matsui, Susono (JP); Akira Sakakibara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 783 days.

(21) Appl. No.: 11/224,010

(22) Filed: Sep. 13, 2005

(65) Prior Publication Data

US 2006/0057483 A1 Mar. 16, 2006

(30) Foreign Application Priority Data

Sep. 13, 2004 (JP) ..... 2004-265663

(51) Int. Cl.
*G03G 9/087* (2006.01)

(52) U.S. Cl. ..... 430/109.4; 430/108.4; 430/108.5

(58) Field of Classification Search ..... 430/108.4, 430/108.5, 109.4
See application file for complete search history.

(56) References Cited

U.S. PATENT DOCUMENTS

| | | | | |
|---|---|---|---|---|
| 6,342,328 | B1 | 1/2002 | Takasaki et al. | 430/108.22 |
| 6,395,442 | B1 | 5/2002 | Hayashi et al. | 430/109.4 |
| 2002/0037468 | A1* | 3/2002 | Matsushima et al. | 430/110.2 |
| 2002/0136976 | A1* | 9/2002 | Ohmura et al. | 430/110.3 |
| 2003/0215732 | A1* | 11/2003 | Uchida et al. | 430/110.3 |
| 2004/0029031 | A1 | 2/2004 | Yamazaki et al. | 430/108.4 |
| 2004/0152006 | A1 | 8/2004 | Teshima | 430/109.4 |
| 2004/0157147 | A1* | 8/2004 | Shiraishi et al. | 430/109.4 |
| 2005/0208407 | A1* | 9/2005 | Nagase et al. | 430/108.21 |

FOREIGN PATENT DOCUMENTS

| | | |
|---|---|---|
| EP | 1 345 086 | 9/2003 |
| JP | 04-184358 | 7/1992 |
| JP | 11-327208 | 11/1999 |
| JP | 2003-207923 | 7/2003 |

OTHER PUBLICATIONS

Office Action issued by the European Patent Office regarding counterpart foreign application No. 05 019 672.4-1217, dated Aug. 25, 2008.

Partial English-language translation of Japanese Office Action issued in counterpart application No. 2005-265107 dated May 11, 2010—4 pages.

* cited by examiner

*Primary Examiner*—Mark F Huff
*Assistant Examiner*—Peter L Vajda
(74) *Attorney, Agent, or Firm*—Fitzpatrick, Cella, Harper & Scinto

(57) ABSTRACT

An object of the present invention is to provide a toner excellent in durability and storage stability, and having good fixing performance in a wide fixing temperature region even at a high process speed. According to the present invention, there is provided a toner containing: a binder resin; a colorant; and a polyester resin, in which: I) the polyester resin contains at least, as a main component, polyester obtained by subjecting a monomer composition containing an alcohol selected from aliphatic diols each having 2 to 22 carbon atoms and a carboxylic acid selected from aliphatic dicarboxylic acids each having 2 to 22 carbon atoms to a polycondensation reaction; and II) a region having a lamellar structure is present at a surface layer of the toner.

11 Claims, 2 Drawing Sheets

TONER

BACKGROUND OF THE INVENTION

1. Field of the Invention

The present invention relates to a toner to be used for developing an electrostatic latent image to be formed in an image forming method such as an electrophotographic method, an electrostatic recording method, a magnetic recording method, or a toner jet recording method.

2. Description of the Related Art

A large number of methods have been conventionally known as electrophotographic methods. A general electrophotographic method involves the steps of: using a photoconductive substance to form an electrostatic latent image on an electrostatic charge image-bearing member (which may hereinafter be referred to as the "photosensitive member") through various means; developing the latent image with toner to form a toner image which is transferred as required onto a recording medium such as paper; and fixing the toner image onto the recording medium by means of heat, pressure, or the like to produce a copied article.

In recent years, analog printers and copying machines have been replaced with digital printers and copying machines. Accordingly, excellent reproducibility of a latent image, high resolution, an increase in printing speed, and a reduction in power consumption have been strongly demanded. For example, when attention is paid to a printer, a ratio of power consumption in a fixing step to the total power consumption is considerably large, and an increase in fixing temperature inevitably increases power consumption. Furthermore, a high fixing temperature involves a problem such as the curling of paper which is to be printed out, so a reduction in fixing temperature has been strongly desired.

A large number of studies have been conventionally made on the fixation of toner at a low temperature. For example, the incorporation of wax as a releasing agent into toner is well known. However, toner containing such releasing agent is apt to deteriorate owing to high degree of duration, although the toner has an expanded temperature region in which fixation can be performed. In addition, the durability of the toner may be insufficient for long-term stable use.

In view of the above, JP 05-273794 A proposes a toner in which filming is suppressed and which provides an image capable of maintaining a high density and high quality for a long time period. In the toner, the value of a ratio Os/Cs in surface composition determined by toner surface analysis and the average lattice length of the toner measured by means of small-angle X-ray scattering are specified.

JP 11-282196 A proposes a toner in which the layer thickness of a lamellar structure to be formed in a wax domain in toner particles is specified in a particular range to improve the low-temperature fixability, offset resistance, and durability of the toner. However, only an approach based on a releasing agent hardly provides toner performance that can sufficiently cope with recent trends, in other words, an increase in speed of a printer and energy savings.

Meanwhile, some toners that are allowed to be capable of being fixed at low temperatures by an approach except the approach based on a releasing agent have been proposed. For example, JP 04-184358 A proposes a small-particle-size toner containing crystalline polyester, the toner being capable of forming an image excellent in fixability and having high resolution. JP2002-287426 A proposes a technique involving adjusting the dispersion domain diameter of crystalline polyester in toner containing the crystalline polyester and an amorphous resin, to provide an image having excellent low-temperature fixability, good storage stability, and high quality. JP 2002-49180 A proposes a toner obtained by salting-out/fusing composite resin particles and colorant particles, in which crystalline polyester is incorporated into a region except the outermost layer of a composite resin particle. The toner provides: a wide fixing temperature region; and excellent durability to prevent filming, fogging, carrier spent, or the like from occurring. There has been also proposed a technique involving adjusting an abundance ratio between the amount of a releasing agent and the amount of a low-softening-point substance in each of the vicinity and inside of the surface of toner containing the releasing agent and the low-softening-point substance, to achieve compatibility between fixability and offset property.

However, none of those conventional toners has sufficiently achieved compatibility between durability in long-term use and low-temperature fixability, and each of them is still susceptible to improvement in terms of storage stability. In particular, when an image forming process speed is high, the time during which toner and a fixing unit are in contact with each other upon fixation is extremely short, so the amount of heat that the toner receives is limited. Therefore, toner to be used for a high-speed printer is requested to have improved low-temperature fixability.

SUMMARY OF THE INVENTION

The present invention aims at providing a toner excellent in low-temperature fixability and storage stability, and capable of providing a high image density without causing fogging or toner fusion even in long-term use.

The present invention also aims at providing a toner having good fixability in a wide fixing temperature range even at a high image forming process speed.

That is, an object of the present invention is to provide a toner containing: a binder resin; a colorant; and a polyester resin, characterized in that:

I) the polyester resin contains at least, as a main component, a crystalline polyester component obtained by subjecting a monomer composition containing, as main components, an alcohol selected from aliphatic diols each having 2 to 22 carbon atoms and a carboxylic acid selected from aliphatic dicarboxylic acids each having 2 to 22 carbon atoms to a polycondensation reaction; and II) a region having a lamellar structure formed of the crystalline polyester component is present at a surface layer of the toner.

DESCRIPTION OF THE PREFERRED EMBODIMENTS

Figure 1:
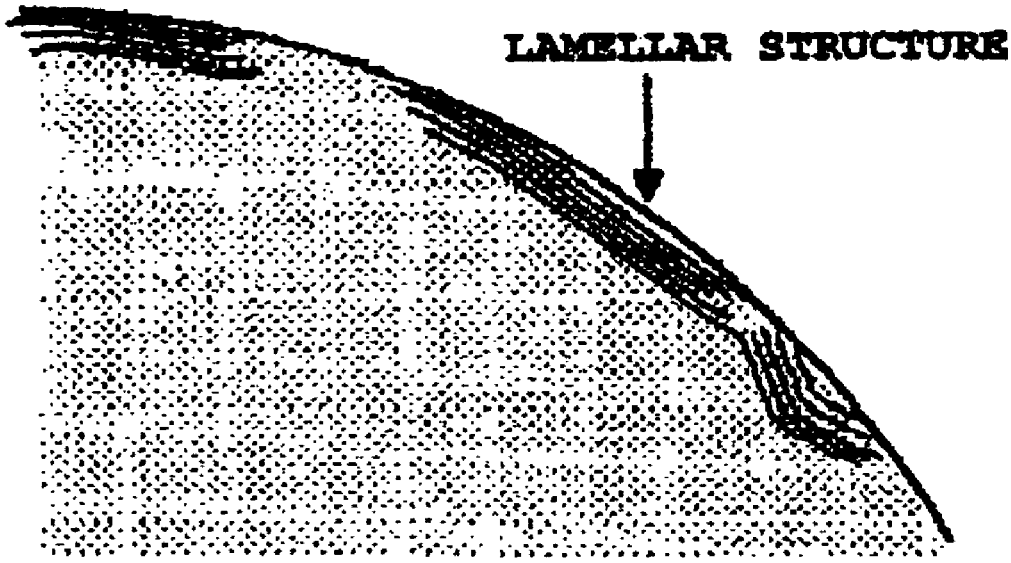
FIG. 1 is a schematic view showing the structure of a toner of the present invention.

The inventors of the present invention have heretofore made extensive studies about the compatibility between the low-temperature fixability and storage stability of toner, and image stability in duration. As a result, they have found that a toner, which contains polyester having a specific structure and has a lamellar structure on its surface layer, has a wide fixing temperature region even at a high process speed and does not cause toner deterioration such as fogging or fusion even in long-term use, thereby completing the present invention.

As described above, the toner of the present invention contains a binder resin, a colorant, and a polyester resin, and may contain an arbitrary component except these components (such as a releasing agent or a resin except the polyester resin).

1. Polyester Resin in Toner of the Present Invention

The polyester resin in the toner of the present invention is composed of a polyester component obtained by subjecting a monomer composition containing at least an alcohol component containing a polyhydric alcohol and a carboxylic acid component containing a polyvalent carboxylic acid, to a polycondensation reaction. The polyester resin may be composed of one kind of polyester component, or may be a combination of two or more kinds of polyester components.

The polyester resin in the toner of the present invention contains at least, as a main component, a crystalline polyester component (which may hereinafter be referred to as the "polyester component A"). The polyester component A is a crystalline polyester component obtained by subjecting a monomer composition to be described later containing at least, as main components, an alcohol selected from aliphatic diols each having 2 to 22 carbon atoms and a carboxylic acid selected from aliphatic dicarboxylic acids each having 2 to 22 carbon atoms, to a polycondensation reaction.

The phrase "contains at least, as a main component, the polyester component A" refers to the fact that the polyester component A accounts for 50 mass % or more of the polyester resin. In the present invention, the polyester component A preferably accounts for 70 mass % or more of the polyester resin.

The polyester resin may also contain an arbitrary polyester component except the polyester component A.

2. Crystalline Polyester Component (Polyester Component A) as Main Component in Polyester Resin As described above, the crystalline polyester component (the polyester component A) as a main component in the polyester resin in the toner of the present invention can be obtained by subjecting a monomer composition containing, as main components, an aliphatic diol having 2 to 22 carbon atoms and an aliphatic dicarboxylic acid having 2 to 22 carbon atoms, to a polycondensation reaction. The phrase "containing, as main components" as used herein refers to the fact that a total amount of the aliphatic dicarboxylic acid and the aliphatic diol accounts for 50 mol % or more (preferably 70 mol % or more) of the monomer composition.

When the main components of the monomer composition are a combination of an aliphatic diol having 2 to 22 carbon atoms and an aliphatic dicarboxylic acid having 2 to 22 carbon atoms, the resultant polyester component A can have increased order of its molecular arrangement, and hence can have an increased degree of crystallinity.

A ratio (on a mole basis) between the acid component and the alcohol component in the monomer composition (acid component:alcohol component) is preferably 60:40 to 40:60.

The aliphatic diol having 2 to 22 (preferably 2 to 12) carbon atoms is preferably, but not particularly limited to, a chain (more preferably linear chain) aliphatic diol. Examples of the chain aliphatic diol include ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol, and neopentyl glycol. Of those, a linear aliphatic α,ω-diol such as ethylene glycol, diethylene glycol, or 1,4-butanediol is preferable.

An alcohol selected from aliphatic diols each having 2 to 22 carbon atoms accounts for preferably 50 mass % or more, or more preferably 70 mass % or more, of the alcohol component.

Polyhydric alcohol monomers except the aliphatic diols can also be used. Examples of a dihydric alcohol monomer out of the polyhydric alcohol monomers include: aromatic alcohols such as polyoxyethylenated bisphenol A and polyoxypropylenated bisphenol A; and 1,4-cyclohexanedimethanol. Examples of a polyhydric alcohol monomer which is trihydric or more out of the polyhydric alcohol monomers include: aromatic alcohols such as 1,3,5-trihydroxy methylbenzene; and aliphatic alcohols such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, and trimethylolpropane.

A monohydric alcohol may also be used to such an extent that the properties of the polyester component A in the present invention are not impaired. Examples of the monohydric alcohol include monofunctional monomers such as n-butanol, isobutanol, sec-butanol, n-hexanol, n-octanol, lauryl alcohol, 2-ethylhexanol, decanol, cyclohexanol, benzyl alcohol, and dodecyl alcohol.

The aliphatic dicarboxylic acid having 2 to 22 (preferably 4 to 14) carbon atoms is preferably, but not particularly limited to, a chain (more preferably linear chain) aliphatic dicarboxylic acid. Specific examples of the aliphatic dicarboxylic acid include oxalic acid, malonic acid, succinic acid, glutaric acid, adipic acid, pimelic acid, suberic acid, glutaconic acid, azelaic acid, sebacic acid, nonane dicarboxylic acid, decane dicarboxylic acid, undecane dicarboxylic acid, dodecanedicarboxylic acid, maleic acid, fumaric acid, mesaconic acid, citraconic acid, and itaconic acid, and acid anhydrides of them. Furthermore, a lower alkyl ester of them may be hydrolyzed to be used as the aliphatic dicarboxylic acid.

A carboxylic acid selected from aliphatic dicarboxylic acids each having 2 to 22 carbon atoms accounts for preferably 50 mass % or more, or more preferably 70 mass % or more, of the carboxylic acid component.

Polyvalent carboxylic acids except an aliphatic dicarboxylic acid having 2 to 22 carbon atoms may be incorporated into the carboxylic acid component. Examples of a divalent carboxylic acid out of the other polyvalent carboxylic acid monomers include: aromatic carboxylic acids such as isophthalic acid and terephthalic acid; aliphatic carboxylic acids such as n-dodecylsuccinic acid and n-dodecenylsuccinic acid; alicyclic carboxylic acids such as cyclohexane dicarboxylic acid; and acid anhydrides of them. Furthermore, a lower alkyl ester of them may be hydrolyzed to be used as a divalent carboxylic acid.

Examples of a polyvalent carboxylic acid which is trivalent or more out of the other carboxylic acid monomers include: aromatic carboxylic acids such as 1,2,4-benzene tricarboxylic acid (trimellitic acid), 2,5,7-naphthalene tricarboxylic acid, 1,2,4-naphthalene tricarboxylic acid, and pyromellitic acid; aliphatic carboxylic acids such as 1, 2, 4-butane tricarboxylic acid, 1,2,5-hexane tricarboxylic acid, and 1,3-dicarboxyl-2-methyl-2-methylenecarboxypropane; and acid anhydrides of them. Furthermore, a lower alkyl ester of them may be hydrolyzed to be used as a polyvalent carboxylic acid.

A monovalent carboxylic acid may also be incorporated into the acid component, to such an extent that the properties of the polyester component A in the present invention are not impaired. Examples of the monovalent carboxylic acid include monocarboxylic acids such as benzoic acid, naphthalene carboxylic acid, salicylic acid, 4-methyl benzoic acid, 3-methyl benzoic acid, phenoxyacetic acid, biphenyl carboxylic acid, acetic acid, propionic acid, butyric acid, octanoic acid, decanoic acid, dodecanoic acid, and stearic acid.

The polyester component A in the present invention can be produced according to an ordinary polyester synthesis method. For example, a desired polyester component A can be obtained by: subjecting the above-described carboxylic acid monomer and the above-described alcohol monomer to an esterification reaction or an ester exchange reaction; and subjecting the resultant to a polycondensation reaction according to an ordinary method under reduced pressure or by introducing a nitrogen gas.

The esterification reaction or the ester exchange reaction can be performed by using, as required, an ordinary esterification catalyst or ester exchange catalyst such as sulfuric acid, titanium butoxide, dibutyltinoxide, manganese acetate, or magnesium acetate.

The polycondensation reaction can be performed by using an ordinary polymerization catalyst, for example, a conventionally known catalyst such as titanium butoxide, dibutyltin oxide, tin acetate, zinc acetate, tin disulfide, antimony trioxide, or germanium dioxide. A polymerization temperature and a catalyst amount are not particularly limited, and may be appropriately determined.

In the esterification reaction or the ester exchange reaction, or in the polycondensation reaction, all monomers may be collectively fed in order to increase the strength of a polyester component to be obtained; or a divalent monomer is allowed to react before a monomer which is trivalent or more is added, and allowed to react in order to reduce a low-molecular-weight component in a polyester component to be obtained.

The content of the polyester component A (when the polyester component A is composed of multiple polyester components, the total content of the multiple components) in the toner of the present invention is preferably 3 to 30 parts by mass, or more preferably 5 to 25 parts by mass with respect to 100 parts by mass of a binder resin.

The content of the polyester component of 3 parts by mass or more with respect to 100 parts by mass of the binder resin can easily allow the polyester component A to be present at the surface layer of the toner. As a result, the properties (described later) of the polyester component A are sufficiently exerted, so the rigidity of the toner can be improved, and hence the storage stability and durability of the toner can be improved. Furthermore, a polyester resin domain having some degree of diameter can be formed inside the toner, so a fixing temperature region can be widened. On the other hand, the content of the polyester component A in excess of 30 parts by mass excessively increases the endotherm of the polyester component A, so low-temperature fixability of the toner is apt to be inhibited.

The toner of the present invention can contain one or more kinds of polyester components, at least one of which is preferably a crystalline polyester component. The term "crystalline polyester" as used herein refers to a polyester having an endothermic peak in the differential scanning calorimetry (DSC) temperature increasing curve and having an exothermic peak in the DSC temperature decreasing curve. Here, DSC is performed in conformity with "ASTM D 3417-99".

The toner of the present invention may contain an amorphous polyester component as well as the crystalline polyester component.

A peak top of the highest endothermic peak in differential scanning calorimetry (DSC) curve of the polyester component A in the present invention is placed at a temperature of preferably 60° C. to 110° C., or more preferably 70° C. to 90° C. The term "highest endothermic peak in differential scanning calorimetry (DSC) curve" refers to the highest peak out of the endothermic peaks in a DSC curve obtained by DSC at increasing temperature.

A polyester component having the peak top at a temperature of 60° C. to 110° C. may allow releasability to be effectively exerted while greatly contributing to the low-temperature fixability of toner. Toner containing the polyester component A having the peak top at a temperature of lower than 60° C. is apt to reduce its releasability and to facilitate the occurrence of toner fusion in duration. On the other hand, toner containing the polyester component A having the peak top at a temperature of higher than 110° C. is not preferable because its fixing temperature is high, although the toner provides a large hot offset resistance effect.

The temperature at which the peak top of the highest endothermic peak in differential scanning calorimetry (DSC) curve of the polyester component A is placed (which may hereinafter be referred to as the peak top temperature) can be controlled by, for example, appropriately adjusting its molecular weight or selecting the kind of a monomer to be used as material.

The DSC can be performed in conformity with ASTM D 3417-99. For example, the DSC is performed by using a DSC-7 manufactured by Perkin Elmer Co., Ltd., a DSC2920 manufactured by TA Instruments Japan Inc., or a Q1000 manufactured by TA Instruments Japan Inc. The temperature of an apparatus detection portion is corrected by means of the melting points of indium and zinc, and a quantity of heat is corrected by means of the heat of melting of indium. A measurement sample (that is, polyester component) is placed into an aluminum pan, and an empty pan is set as a control.

The polyester component A in the toner of the present invention may be compatible with a binder resin when the toner is heated. An ordinary DSC measurement mode includes the processes of first increasing temperature, decreasing temperature, and second increasing temperature. A peak top temperature is determined from a DSC curve in the second increasing temperature. At that time, when the toner including the polyester component A is slowly heated to 180° C. in the first increasing temperature, part of the polyester component A may be compatible with a binder resin. Therefore, it is not preferable to perform DSC of the polyester component A in the toner of the present invention in an ordinary measurement mode.

Therefore, the DSC of the polyester component A in the toner of the present invention is performed by means of the following "modulated mode". The temperature at which the peak top of the highest endothermic peak is placed is determined from a DSC curve at increasing temperature obtained by means of the modulated mode.

Measurement Conditions for Modulated Mode

Equilibrium is kept at 20° C. for 1 minute.

A modulation with an amplitude of 1.5° C. and a frequency of 1/min is applied to increase the temperature up to 180° C. at 2° C./min.

Equilibrium is kept at 180° C. for 10 minutes.

A modulation with an amplitude of 1.5° C. and a frequency of 1/min is applied to decrease the temperature to 20° C. at 2° C./min.

The polyester component A in the present invention has a number average molecular weight (Mn) of preferably 2,000 to 10,000, or more preferably 2,000 to 6,000. A number average molecular weight of less than 2,000 is apt to deteriorate the storage stability and durability of the toner because the amount of an oligomer component increases. In addition, it becomes difficult to maintain a diameter of domain of the polyester component A inside the toner to be described later, because the compatibility of the component A with a binder resin increases. On the other hand, toner containing the polyester component A having a number average molecular weight in excess of 10,000 may have impaired low-temperature fixability, although the toner has high duration stability.

When the toner of the present invention is to be produced by means of a polymerization method as described below, the polyester component A having a number average molecular weight in excess of 10,000 is not preferable, because the component has low solubility in a polymerizable monomer, so production stability is apt to deteriorate.

The number average molecular weight of the polyester component A can be determined by means of a GPC method. A specific measurement procedure involves: dispersing or dissolving 0.03 g of polyester to be subjected to measurement into 10 ml of o-dichlorobenzene; shaking the resultant solution at 135° C. for 24 hours by means of a shaker; filtering the shaken solution through a 0.2-μm filter; and subjecting the resultant filtrate as a sample to measurement under the following analysis conditions.

[Analysis Conditions]

Separation column: Shodex (TSK GMHHR-H HT20)×2

Column temperature: 135° C.

Moving phase solvent: o-dichlorobenzene

Moving phase flow rate: 1.0 ml/min

Sample concentration: About 0.3%

Injection volume: 300 μl

Detector: Differential refractometer SHODEX RI-71

A molecular weight calibration curve created by means of a standard polystyrene resin is used for calculating the molecular weight of a sample. Examples of the standard polystyrene resin include TSK Standard Polystyrene F-850, F-450, F-288, F-128, F-80, F-40, F-20, F-10, F-4, F-2, F-1, A-5000, A-2500, A-1000, and A-500 (manufactured by Tosoh Corporation).

A states of presence of the polyester component A at the surface layer and the inside of the toner of the present invention can be controlled by adjusting the acid value of the polyester component A when the toner is produced in an aqueous medium by means of a polymerization method as described later. To be specific, the polyester component A having a high acid value tends to be present at the surface layer of the toner particle because of its high hydrophilicity. In contrast, the polyester component A having a low acid value tends to be present inside the toner particle. Accordingly, a toner having a lamellar structure at each of its surface layer and the inside thereof can be easily obtained by adjusting the acid value of the polyester component A.

The acid value of the polyester component A is preferably 20 mgKOH/g or less. An excessively high acid value tends to reduce the durability of toner because the miscibility of the polyester component A with a binder resin or any other component constituting the toner reduces, and hence the liberation of the polyester component A is apt to occur. When toner is produced in an aqueous medium as described later, the polyester component A having a too high acid value excessively concentrates on the surface layer of the toner, so granulation stability tends to reduce and the particle size distribution of the toner tends to be broad.

The acid value of the polyester component A is measured in conformity with JIS-K0070. A specific measurement procedure is shown below.

(1) Preparation of Reagent

Preparation of solvent (a): An ethyl ether-ethyl alcohol mixed solution (1+1 or 2+1) or a benzene-ethyl alcohol mixed solution (1+1 or 2+1), which is neutralized immediately before use with a 0.1-mol/l solution of potassium hydroxide in ethyl alcohol by means of phenolphthalein as an indicator.

Preparation of phenolphthalein solution (b): 1 g of phenolphthalein is dissolved into 100 ml of ethyl alcohol (95 v/v %).

Preparation of 0.1-mol/l solution of potassium hydroxide in ethyl alcohol (c): 7.0 g of potassium hydroxide are dissolved into as small an amount of water as possible. The solution is added with ethyl alcohol (95 v/v %) to have a total volume of 1 liter, and the resultant is left for 2 to 3 days and filtered.

(2) Operation 1 to 20 g of a sample (polyester component) are precisely weighed and added with 100 ml of the solvent (a) and several droplets of the phenolphthalein solution (b) as an indicator, and the whole is sufficiently shaken until the sample is completely dissolved. A solid sample can be dissolved by heating on a water bath. After having been cooled, the resultant is titrated with the 0.1-mol/l solution of potassium hydroxide in ethyl alcohol (c). The amount of the solution at which the reddish color of the indicator lasts for 30 seconds is defined as the end point of the neutralization.

(3) Formula

The acid value is calculated on the basis of the foregoing results by means of the following formula.

$$A=(B\times f\times 5.611)/S$$

In the formula, A represents an acid value, B represents the amount (ml) of the 0.1-mol/l solution of potassium hydroxide in ethyl alcohol, f represents the factor of the 0.1-mol/l solution of potassium hydroxide in ethyl alcohol, and S represents the amount (g) of the sample.

3. Colorant in Toner of the Present Invention

The colorant in the toner of the present invention may be any one of conventionally known organic pigments or dyes, carbon black, a magnetic powder, and the like. Specific examples of the colorant are given below.

Each of a copper phthalocyanine compound and a derivative thereof, an anthraquinone compound, a basic dye lake compound, and the like can be used as a cyan-based colorant. Specific examples of the colorant include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

A condensed azo compound, a diketopyrrolopyrrole compound, anthraquinone, a quinacridone compound, a basic dye lake compound, a naphthol compound, a benzimidazolone compound, a thioindigo compound, or a perylene compound is used as a magenta-based colorant. Specific examples of the colorant include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

A compound typified by a condensed azo compound, an isoindolinone compound, an anthraquinone compound, an azo metal complex, a methine compound, or an allylamide compound is used as a yellow-based colorant. Specific examples of the colorant include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C. I. Pigment Yellow 194.

Each of those cyan-, magenta-, and yellow-based colorants can be used alone, or two or more of them can be used as a mixture. In addition, each of them can be used in the state of a solid solution. Those colorants can be appropriately selected in terms of a hue angle, chroma, brightness, light resistance, OHP transparency, and dispersibility into toner. The content of those colorants in the toner of the present invention is preferably 1 to 20 parts by mass with respect to 100 parts by mass of the binder resin.

Each of carbon black, one toned to black by means of the above yellow/magenta/cyan colorants, and a magnetic powder to be described later can be used as a black colorant.

When carbon black is used as the black colorant, the content of carbon black in the toner is preferably 1 to 20 parts by mass with respect to 100 parts by mass of the binder resin.

When a magnetic powder is used as the black colorant, the content of the magnetic powder in the toner is preferably 20 to 150 parts by mass with respect to 100 parts by mass of the binder resin. The content of less than 20 parts by mass provides the toner with poor coloring power and makes it difficult to suppress fogging, although the content provides good fixability. On the other hand, the content in excess of 150 parts by mass is not preferable because a fixability of toner deteriorates, and besides the holding power of a toner carrier through magnetic force strengthens, so developability reduces. The kind and production method of the magnetic powder will be described in detail later.

The content of the magnetic powder in the toner can be measured by means of a thermoanalysis apparatus TGA7 manufactured by Perkin Elmer Co., Ltd. A measurement method involves: heating the toner from normal temperature to 900° C. at a rate of temperature increase of 25° C./min in a nitrogen atmosphere; defining a reduced mass % from 100° C. to 75° C. as a binder resin amount; and approximately defining the remaining weight as a magnetic powder amount.

The toner of the present invention can contain any other colorant together with a magnetic powder. Examples of the other colorant to be incorporated include: magnetic or non-magnetic inorganic compounds; and conventionally known dyes and pigments. Specific examples thereof include: ferromagnetic metal particles made of cobalt, nickel, and the like, and alloys prepared by adding chromium, manganese, copper, zinc, aluminum, rare earth elements, and the like to these ferromagnetic metals; particles made of hematite and the like; titanium black; nigrosin dyes/pigments; carbon black; and phthalocyanine.

When the toner of the present invention is produced by means of a polymerization method as described later, attention must be paid to the polymerization inhibiting property and transferring property of a colorant to an aqueous-phase. Therefore, the colorant is preferably subjected to a surface treatment (for example, a hydrophobic treatment with a substance having no polymerization inhibiting property). In particular, attention must be paid to the use of dye-based colorants and carbon black because many of these colorants have polymerization inhibiting properties. An example of a preferable method of subjecting a dye-based colorant to a surface treatment includes a method involving polymerizing a polymerizable monomer in the presence of such dye-based colorant in advance. The resultant colored polymer is added to a monomer composition. The surface of carbon black may be treated as in the case of the above dye, or may be treated with a substance that reacts with a surface functional group of carbon black, for example, polyorganosiloxane.

The magnetic powder is also preferably subjected to a surface treatment. Details about the surface treatment of the magnetic powder will be described later.

4. Binder Resin in Toner of the Present Invention

A binder resin to be incorporated in the toner of the present invention varies depending on a method of producing the toner. The methods of producing the toner, which will be described in detail later, are roughly classified into a polymerization method and a pulverization method.

The binder resin of the toner to be produced by means of a polymerization method is a polymer formed from a polymerizable monomer in a polymerizable monomer composition. Examples of the polymerizable monomer include compounds each having an addition-polymerizable carbon double bond including: 1) styrene-based monomers such as styrene, o-methylstyrene, m-methylstyrene, p-methylstyrene, p-methoxystyrene, and p-ethylstyrene; 2) acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; 3) methacrylates such as methyl methacrylate, ethyl methacrylate, n-propyl methacrylate, n-butyl methacrylate, isobutylmethacrylate, n-octylmethacrylate, dodecyl methacrylate, 2-ethylhexyl methacrylate, stearyl methacrylate, phenyl methacrylate, dimethylaminoethyl methacrylate, and diethylaminoethyl methacrylate; and 4) acrylonitrile, methacrylonitrile, and acrylamide.

The binder resin of the toner to be produced by means of a polymerization method is a polymer from a monomer composition containing one of those monomers or a mixture of multiple kinds of them. Of those, styrene alone, a mixture of styrene and an acrylate, or a mixture of styrene and a methacrylate is preferably used in terms of the developing property and durability of the toner.

Next, examples of an available binder resin of the toner to be produced by means of a pulverization method include: 1) homopolymers of styrene or a substituted styrene, such as polystyrene and polyvinyl toluene; 2) styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and 3) polymethylmethacrylate, polybutylmethacrylate, polyvinylacetate, polyethylene, polypropylene, polyvinylbutyral, a silicone resin, a polyester resin, a polyamide resin, an epoxy resin, and a polyacrylic resin. Each of them can be used alone, or two or more of them can be used in combination. Of those, a styrene-based copolymer and a polyester resin are particularly preferable in terms of developing property, fixability, and the like.

5. Releasing Agent in Toner of the Present Invention

The toner of the present invention preferably contains a releasing agent. The low-temperature fixability of the toner can be additionally improved by incorporating the releasing agent together with the polyester resin into the toner. A possible reason why such improvement can be achieved will be described in detail later.

A conventionally known releasing agent can be used as the releasing agent, and examples thereof include: 1) petroleum-based waxes such as a paraffin wax, a microcrystalline wax, and petrolactum, and derivatives thereof; 2) a montan wax and a derivative thereof; 3) a hydrocarbon-based wax according to a Fischer-Tropsch method and a derivative thereof; 4) polyolefin waxes typified by polyethylene and derivatives thereof; and 5) natural waxes such as a carnauba wax and a candelilla wax, and derivatives thereof. The term "derivative" as used herein comprehends oxides, block copolymers with vinyl-based monomers, and graft denatured products.

Examples of a releasing agent that can be used further include: high aliphatic alcohols; aliphatic acids such as stearic acid and palmitic acid, and derivatives thereof; acid amide waxes; ester waxes; ketones; a hardened castor oil and a derivative thereof; plant waxes; and animal waxes.

A peak top of the highest endothermic peak in differential scanning calorimetry (DSC) curve of the releasing agent is placed at a temperature in the region of preferably 30 to 100° C., or more preferably 35 to 90° C. Toner containing a releasing agent, of which the peak top in DSC is placed at a temperature in the region lower than 30° C., is apt to cause the releasing agent component to exude even at normal temperature, so its storage stability is apt to deteriorate. Meanwhile, toner containing a releasing agent, of which the peak top is placed at a temperature in the region higher than 100° C., has a high fixing temperature, so low-temperature offset is apt to occur. As described later, when toner is to be directly obtained in an aqueous medium by means of a polymerization method, the addition of a large amount of releasing agent, of which the peak top is placed at a high temperature (in excess of 100° C.), is apt to involve the occurrence of a problem such as the precipitation of a releasing agent component during granulation.

The DSC of the releasing agent can be performed in conformity with ASTM D 3417-99 in the same manner as in the DSC of the polyester resin.

In the toner of the present invention, a ratio (Wc/Pc) of the content mass (Wc) of the releasing agent to the content mass (Pc) of the polyester component A (when the polyester component A is composed of multiple polyester components, the total content mass of the multiple components) is in the range of preferably 0.5 to 8.0, or more preferably 0.5 to 4.0.

When the ratio is less than 0.5, the amount of exudation of the releasing agent involved in the deformation of the toner during toner fixation to be described later is not sufficient. On the other hand, when the ratio Wc/Pc is more than 8.0, the releasing agent is apt to exude owing to a slight impact during a step except fixation (such as development or transfer), so developability and durability are apt to deteriorate.

6. Other Arbitrary Components in Toner of the Present Invention

As described above, the toner of the present invention contains a binder resin, a colorant, and a polyester resin, and preferably further contains a releasing agent. The toner of the present invention can contain any other arbitrary component. Examples of the arbitrary component include a charge control agent, a resin except the binder resin and the polyester resin, a magnetic powder, and an external additive.

A charge control agent can stabilize the charging property of the toner. A conventionally known charge control agent can be used as the charge control agent. In particular, a charge control agent capable of being charged quickly or capable of stably maintaining a constant charge amount is preferable. When toner is to be directly produced by means of a polymerization as described later, a charge control agent having low polymerization inhibiting property and having substantially no constituent solubilized into an aqueous dispersion medium is particularly preferable.

Specific examples of a compound to serve as a negative charge control agent include: metal compounds of aromatic carboxylic acids such as salicylic acid, alkyl salicylic acid, dialkyl salicylic acid, naphthoic acid, and dicarboxylic acid; metal salts or metal complexes of azo dyes or of azo pigments; polymeric compounds each having a sulfonic acid group or a carboxylic acid group at a side chain thereof; boron compounds; urea compounds; silicon compounds; and calixarene. Specific examples of a compound to serve as a positive charge control agent include: quaternary ammonium salts; polymeric compounds having the quaternary ammonium-salt-group at their side chains; guanidine compounds; nigrosin-based compounds; and imidazole compounds. Those charge control agents are preferably used in an amount of 0.5 to 10 parts by mass with respect to 100 parts by mass of the polymerizable monomer.

A polymer having a sulfonic acid group, a sulfonic acid salt group, or a sulfonic ester group is preferably used as a charge control agent in terms of charge stability and durability of the toner. When the polyester resin according to the present invention is combined with the polymer, the polymer tends to be uniformly present near the surface layer of a toner particle, so charge stability and duration stability of the toner are improved. The polymer is preferably a copolymer of: an acrylamide-based monomer or methacrylamide-based monomer containing at least one of a sulfonic acid group, a sulfonic acid salt group, and a sulfonic ester group in a molecule; and another monomer. The acrylamide-based or methacrylamide-based monomer is preferably 2-acrylamide-2-methylpropane sulfonic acid or 2-methacrylamide-2-methylpropane sulfonic acid in terms of chargeability.

The toner of the present invention does not necessarily contain a charge control agent. For example, the toner of the present invention is not requested to contain a charge control agent in some cases when frictional charging with a toner layer thickness regulating member or with a developer carrier of an image forming apparatus is actively utilized.

The toner of the present invention may contain a resin except the binder resin and the polyester resin. For example, the toner may contain a resin containing a polar functional group. Incorporating such resin can allow for occurrence of more distinct phase separation of the releasing agent from the binder resin in the toner, so the releasing agent can be included within the toner with improved strength. As a result, toner with good offset resistance, good blocking resistance, and good low-temperature fixability can be obtained.

Examples of the resin containing a polar functional group include copolymers (including random copolymers, block copolymers, and graft copolymers) of: addition polymerizable monomers each containing a hydrophilic functional group such as an amino group, a carboxylic acid group, a hydroxyl group, a sulfonic acid group, a glycidyl group, or a nitrile group; and vinyl compounds such as styrene and ethylene. The examples also include polycondensates such as polyamide, and polyaddition polymers such as polyether and polyimine.

The resin containing a polar functional group has an average molecular weight of preferably 2,000 or more, or more preferably 3,000 or more. An average molecular weight of the resin of less than 3,000 (particularly less than 2,000) is apt to have unpreferable influences on the developability and blocking resistance of the toner, because the low-molecular-weight resin containing a polar functional group is apt to concentrate on the vicinity of the surface layer of the toner when the toner is produced by means of a polymerization method to be described later.

The content of the resin containing a polar functional group in the toner of the present invention is preferably 1 to 20 parts by mass with respect to 100 parts by mass of the binder resin. The content of less than 1 part by mass makes an effect of the addition of the resin small, while the content in excess of 20 parts by mass makes it difficult to design various physical properties when the toner is produced by means of a polymerization method to be described later.

The toner of the present invention may contain a resin having a molecular weight different from the molecular weight range of the binder resin. Incorporating a resin having such molecular weight can provide toner having a wide molecular weight distribution and high offset resistance.

When the toner of the present invention is used as magnetic toner, the toner may contain a magnetic powder. As described above, the toner may also contain a magnetic powder as the colorant. The magnetic powder that can be incorporated into the toner of the present invention is mainly composed of iron oxide such as triiron tetraoxide or γ-iron oxide, and may contain an element such as phosphorus, cobalt, nickel, copper, magnesium, manganese, aluminum, or silicon.

The magnetic powder has a BET specific surface area according to a nitrogen adsorption method of preferably 2 to 30 $m^2/g$, or more preferably 3 to 28 $m^2/g$. In addition, the magnetic powder preferably has a Mohs hardness of 5 to 7. Examples of the shape of the magnetic powder include a polygonal shape, an octahedral shape, a hexagonal shape, a spherical shape, a needle-like shape, and a flaky shape. Of those, a shape having low anisotropy such as a polygonal shape, an octahedral shape, a hexagonal shape, or a spherical shape is preferable for increasing an image density.

The volume average particle size of the magnetic powder is preferably 0.10 to 0.40 μm. In general, a magnetic powder having a smaller particle size is not preferable because it is more likely to aggregate, so the uniform dispersibility of the magnetic powder into toner deteriorates, although the magnetic powder has higher coloring power. In addition, a magnetic powder having a volume average particle size of less than 0.10 μm itself has a reddish black color, so an image (especially a half tone image) to be formed by means of toner containing the magnetic powder is remarkably reddish and may not have high quality. On the other hand, a magnetic powder having a volume average particle size in excess of 0.40 μm provides toner with insufficient coloring power, and is hardly dispersed uniformly into toner obtained through a suspension polymerization method (described later), which is a preferable method of producing the toner of the present invention.

The volume average particle size of the magnetic powder can be measured by means of a transmission electron microscope (TEM). A specific method involves: sufficiently dispersing toner particles of toner to be observed into an epoxy resin; curing the resultant for 2 days in an environment having a temperature of 40° C.; cutting the resultant cured product into a flaky sample by means of a microtome; observing the photograph of the sample at a magnification of ×10,000 or ×40,000 by means of a transmission electron microscope (TEM) to measure the particle sizes of 100 magnetic powder particles in the field of view; and calculating a volume average particle size on the basis of the equivalent diameter of a circle equal to the projected area of the magnetic powder. A particle size can also be measured by means of an image analyzer.

The magnetic powder to be incorporated into the toner of the present invention can be produced by means of, for example, the following method.

An alkali such as sodium hydroxide is added to an aqueous solution of a ferrous salt, in an amount equivalent to or more than an iron component of the solution, to thereby prepare an aqueous solution containing ferrous hydroxide. Air is blown while the pH of the prepared aqueous solution is maintained at 7 or more, and an oxidation reaction of ferrous hydroxide is performed while the aqueous solution is heated to 70° C. or higher. Thus, a seed crystal serving as a core of a magnetic iron oxide powder is first produced.

Next, to the obtained slurry-like liquid containing the seed crystal, an aqueous solution containing about 1 equivalent of ferrous sulfate based on the amount of the alkali previously added is added. Air is blown while the pH of the liquid is maintained at 5 to 10, and an oxidation reaction of ferrous hydroxide is advanced to grow the magnetic iron oxide powder with the seed crystal as a core. At this time, the shape and magnetic properties of the magnetic powder can be controlled by arbitrarily selecting a pH, a reaction temperature, and a stirring condition. As the oxidation reaction proceeds, the pH of the liquid shifts to lower value. However, the pH of the liquid is not preferably less than 5. The magnetic substance thus obtained is filtered out, washed, and dried according to an ordinary method to provide a magnetic powder.

When the toner of the present invention is produced by means of a polymerization method as described later, the surface of the magnetic powder is preferably subjected to a hydrophobic treatment. When a dry surface treatment of a magnetic powder is performed, the magnetic powder that has been washed, filtered out, and dried is subjected to the treatment with a coupling agent. When a wet surface treatment of a magnetic powder is performed, 1) after the completion of an oxidation reaction, the magnetic powder is redispersed into another aqueous medium; or after the completion of the oxidation reaction, the magnetic powder obtained as a result of washing and filtering out is redispersed into another aqueous medium without being dried, 2) the pH of the resultant redispersion liquid is allowed to fall within an acidic region, 3) a silane coupling agent is added to the redispersion liquid while being sufficiently stirred, and 4) after hydrolysis, a coupling treatment can be performed by increasing a temperature or by adjusting the pH to fall within an alkali region. In particular, the surface treatment performed by redispersing a magnetic powder, which has been obtained through filtering out and washing without drying after the completion of the oxidation reaction, is preferable in view of performing a uniform surface treatment.

When the surface of the magnetic powder is subjected to a wet treatment, in other words, the surface is treated with a coupling agent in an aqueous medium, at first, the magnetic powder is sufficiently dispersed into the aqueous medium to have a primary particle size, and the dispersion liquid is stirred by means of a stirring blade or the like to prevent the magnetic powder from precipitating or aggregating. Next, an arbitrary amount of a coupling agent is placed into the resultant to treat the surface of the magnetic powder while the coupling agent is hydrolyzed. At this time as well, it is more preferable to perform the surface treatment while the magnetic powder is sufficiently dispersed through stirring the dispersion liquid by means of a device such as a pin mill or a line mill, to prevent the magnetic powder from aggregating.

The term "aqueous medium" as used herein refers to a medium mainly composed of water. Specific examples thereof include water itself, water added with a small amount of a surfactant, water added with a pH adjustor, and water added with an organic solvent. A nonionic surfactant such as polyvinyl alcohol is preferably used as the surfactant. The amount of the surfactant to be added is preferably 0.1 to 5.0 mass % with respect to water. Examples of the pH adjustor include inorganic acids such as hydrochloric acid. Examples of the organic solvent include alcohols.

Examples of a coupling agent that can be used for treating the surface of the magnetic powder include a silane coupling agent and a titanium coupling agent. A silane coupling agent is preferably used, and is represented by a general formula (I).

$$R_mSiY_n \quad (I)$$

[In the formula, R represents an alkoxy group, m represents an integer of 1 to 3, Y represents a hydrocarbon group such as an alkyl group or a vinyl group, a methacryl group, or a glycidoxy group, and n represents an integer of 1 to 3, provided that m+n=4.]

Examples of the silane coupling agent represented by the general formula (I) include vinyltrimethoxysilane, vinyltriethoxysilane vinyltris(β-methoxyethoxy)-silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-decyltrimethoxysilane, hydroxypropyltrimethoxysilane, n-hexadecyltrimethoxysilane, and n-octadecyltrimethoxysilane.

Of those, an alkyltrialkoxysilane coupling agent represented by the following general formula (II) is preferably used for obtaining high hydrophobicity.

$$C_pH_{2p+1}—Si(—OC_qH_{2q+1})3 \quad (11)$$

[In the formula, p represents an integer of 2 to 20, and q represents an integer of 1 to 3.]

When p in the general formula (II) is smaller than 2, it is difficult to impart sufficient hydrophobicity to magnetic powder. When p is greater than 20, the coalescence of magnetic powders is apt to occur frequently, although the hydrophobicity is sufficient. When q is greater than 3, the reactivity of the silane coupling agent reduces, so a hydrophobic treatment is hardly performed sufficiently. Therefore, an alkyltrialkoxysilane coupling agent represented by the formula in which p represents an integer of 2 to 20 (more preferably an integer of 3 to 15) and q represents an integer of 1 to 3 (more preferably an integer of 1 or 2) is preferably used.

When such silane coupling agents as described above are used, the magnetic powder can be treated with one kind of them or a combination of multiple kinds of them. When multiple kinds are used in combination, the magnetic power can be treated with each coupling agent in order or the multiple kinds at the same time.

100 parts by mass of the magnetic powder are preferably treated with a total amount of 0.9 to 3.0 parts by mass of a coupling agent. It is important to appropriately adjust the amount of the coupling agent depending on, for example, the surface area of the magnetic powder and the reactivity of the coupling agent.

An external additive may be externally added to the toner of the present invention. Examples of the external additive include: an inorganic fine powder or hydrophobic inorganic fine powder that can act as a fluidity improver; an inorganic fine particle or organic fine particle capable of improving cleaning property; and other additives. The amount of the external additive in the toner of the present invention is preferably 0.1 to 5 parts by mass (preferably 0.1 to 3 parts by mass) with respect to 100 parts by mass of the toner.

Preferable examples of the inorganic fine powder or hydrophobic fine powder as a fluidity improver include a titanium oxide fine powder, a silica fine powder, and an alumina fine powder. Of those, a silica fine powder is particularly preferable. In particular, an inorganic fine powder having a specific surface area according to nitrogen adsorption measured by means of a BET method of 30 $m^2/g$ or more (especially 50 to 400 $m^2/g$) is preferable for improving fluidity.

The toner of the present invention may be added with an external additive except a fluidity improver as required. In a preferred embodiment, the toner is added with a fine particle having a primary particle size in excess of 30 nm (and preferably having a specific surface area of less than 50 $m^2/g$), or more preferably an inorganic fine particle or organic fine particle which has a primary particle size of 50 nm or more (and preferably has a specific surface area of less than 30 $m^2/g$) and is of a nearly spherical shape, for the purpose of improving cleaning property and for other purposes. For example, a spherical silica particle, a spherical polymethylsilsesquioxane particle, or a spherical resin particle is preferably used.

Examples of other additives include: lubricant powders such as a polyethylene fluoride powder, a zinc stearate powder, and a polyvinylidene fluoride powder; abrasives such as a cerium oxide powder, a silicon carbide powder, and a strontium titanate powder; caking inhibitors; and conductivity imparting agents such as a carbon black powder, a zinc oxide powder, and a tin oxide powder. A small amount of organic and inorganic fine particles opposite in polarity to a toner particle can be added as a developability improver. The surface of each of those additives may be subjected to a hydrophobic treatment before the additives are used.

The toner of the present invention can be used as each of a one-component developer and a two-component developer. When the toner is used as a two-component developer, it is needless to say that the toner is mixed with a carrier. A preferable carrier can be appropriately selected by one skilled in the art.

7. Structure, Physical Properties, and the Like of Toner of the Present Invention The toner of the present invention is characterized in that a region having a lamellar structure is present at the surface layer of the toner. The term "lamellar structure" refers to a layer structure generated by crystallization due to folding of the molecular chain of a crystalline polymer, the layer structure being a higher-order structure having an energetically stable crystalline structure. That is, the phrase "a region having a lamellar structure is present at the surface layer of the toner" refers to the fact that a crystalline polymer having high hardness is present at the surface layer of the toner. The presence of a region having a lamellar structure at the surface layer improves the rigidity of the toner, so toner fusion, a reduction in duration density, fogging, and the like are reduced.

The term "surface layer of the toner" means "a layer ranging from the surface of a toner particle to a position at 0.2 time a depth as the diameter of the toner particle". The lamellar structure present at the surface layer of the toner can be observed by means of a TEM. Details about the observing will be described later.

A crystalline polymer generally has a melting point, and is often a low-softening-point substance. That is, the polymer can be instantaneously melted at a certain temperature or higher temperatures. Therefore, when such substance is present near the surface layer of the toner, the melting rates of the substance and exudation rates of the substance from the toner increase, owing to heat from a fixing unit at the time of fixation. Accordingly, sufficient low-temperature fixability and a sufficient fixing region can be ensured even when the toner is used in a high-speed printer.

As described above, the lamellar structure is formed of a crystalline polymer. The crystalline polymer preferably has a high degree of crystallinity because, in general, a polymer having a higher degree of crystallinity has higher hardness, so the durability of the toner of the present invention is improved.

The crystalline polymer of which the lamellar structure present at the surface layer of the toner of the present invention is formed is preferably the polyester component A described above. The polyester component A is a polyester component having a high degree of crystallinity because it contains, as constitutional units, an aliphatic alcohol and an aliphatic carboxylic acid. Therefore, the polyester component A forms the lamellar structure at the surface layer of the toner, so the toner has a surface layer protected by a hard substance and hence has high durability.

In the toner of the present invention, a region having a lamellar structure is preferably present at each of the surface layer of the toner and inside the toner.

As described above, the presence of a region having a lamellar structure at the surface layer of the toner can achieve compatibility between the low-temperature fixability and duration stability of the toner. In addition, the presence of a region having a lamellar structure inside the toner can drastically improve the low-temperature fixability of the toner.

The reason why the low-temperature fixability of the toner is drastically improved is considered to be as follows, but is not limited to the following one. A substance of which a lamellar structure present inside the toner is formed, that is a crystalline polymer, melts instantaneously at the time of toner fixation as in the case of a crystalline polymer near the surface layer of the toner. The molten crystalline polymer is hardly compatible with a binder resin within an instantaneous heating time in fixation, because the polymer has a high melting viscosity unlike a low-molecular-weight compound such as wax. Therefore, the crystalline polymer of which the lamellar structure inside the toner is formed melts while maintaining its shape before melting at the moment when heat is applied to the toner, so it is in a state like so-called "liquid-core toner". Since such toner can be deformed very easily, the toner can be instantaneously collapsed at a fixing nip portion. Accordingly, sufficient fixing performance can be probably obtained even in an image forming method involving a high process speed.

The substance of which the lamellar structure present inside the toner is formed is preferably the polyester component A described above. The presence of a linear polyester having a high degree of crystallinity inside the toner allows a promoting effect of such pseudo-liquid-core toner structure as described above on deformation to be sufficiently exerted.

A domain of the above-described polyester resin having a circle-equivalent diameter of 0.3 to 3.0 μm is preferably present inside the toner of the present invention. Moreover, a lamellar structure is preferably formed of the polyester resin of which the domain is formed.

The presence of a domain of the polyester resin having a certain size inside the toner improves the above-described liquid-core effect. When the domain diameter of the polyester resin is smaller than 0.3 μm, a sufficient promoting effect on the deformation of the toner may not be obtained even when the polyester resin melts at the time of fixation. In contrast, when the domain diameter of the polyester resin is larger than 3.0 μm, the dispersibility of any other additive (such as the colorant or the releasing agent) into the toner particle reduces, so a problem concerning developability such as fogging is apt to occur, although a large promoting effect on the deformation of the toner is obtained.

How the lamellar structure is present inside the toner can be observed through cross-sectional observation by means of a transmission electron microscope (TEM). A preferable specific method involves: sufficiently dispersing particles to be observed into a normal temperature-curable epoxy resin; curing the resultant for 2 days in an environment having a temperature of 40° C. to produce a resin cured product; forming the resultant cured product, which maybe or may not be frozen, into a flaky shape by means of a microtome equipped with a diamond tooth; and observing the resultant flaky cured product as a sample by means of a TEM. TEM photography was performed at a magnification of ×50,000, and the photography was extended by a factor of 3 through photofinishing before the observation.

A specific method of measuring the domain diameter of the polyester resin involves: determining a circle-equivalent diameter from the cross-sectional area of the toner in the photograph provided by the microscope (TEM); selecting, as corresponding particles, particles whose circle-equivalent diameters are determined to fall within the range of the number average particle size of the toner measured by means of the coulter counter (described later)±10%; measuring the cross-sectional area of the polyester resin in the toner for each of 100 particles out of the corresponding particles to determine a circle-equivalent diameter; and calculating the average value, which is defined as the domain diameter of the polyester resin.

As described above, the toner of the present invention preferably contains a releasing agent. Details about the fact are unclear, but are considered to be as follows. The toner of the present invention that has received heat from a fixing unit forms "liquid-core toner", and the formed "liquid-core toner" is instantaneously deformed at a fixing nip. At the time of the deformation, the releasing agent exudes in a stroke to be compatible with the binder resin, so the softening of the toner and the anchoring of the toner to a medium (adhesiveness) are promoted. Therefore, on condition that the lamellar structure of polyester is present at the surface layer of the toner (and, preferably, inside the toner), incorporating the releasing agent can additionally reduce the temperature at which fixation can be performed.

The toner of the present invention preferably has an average circularity of 0.950 or more. The average circularity refers to the average value of a circularity frequency distribution.

When toner particles are uniformly of nearly spherical shapes, an area of contact between toner and a fixing unit is also uniform. Therefore, the polyester resin present at the surface layer of the toner particle stably melts, so a quantity of heat can be propagated to the entire toner particle. As a result, an effect that stable fixability is exerted even at a high process speed, which is one feature of the toner of the present invention, may be exerted with improved effectiveness.

The average circularity C is calculated from the following expression when central value of the circularity of a divisional point i in a particle size distribution is denoted by ci, and the number of measured particles is denoted by m.

$$\text{Average Circularity } C = \sum_{i-1}^{m} ci/m$$

The circularity is determined from the following expressions. The term "particle projected area" in the following expressions is defined as the area of a binarized toner particle image, while the term "circumferential length of a particle projected image" in the expressions is defined as the length of a borderline obtained by connecting the edge points of the toner particle image. The "particle projected area" and the "circumferential length of a particle projected image" are measured by using a toner particle image that has been subjected to image processing at an image processing resolution of 512×512 (a pixel measuring 0.3 μM×0.3 μm).

The circularity in the present invention is an indication of the degree of irregularities on a particle. The circularity is 1.000 when the toner particle has a completely spherical shape. The more complicated the surface shape, the lower the circularity.

$$\text{Circle-equivalent diameter} = (\text{Particle projected area}/n)^{1/2} \times 2$$

$$\text{Circularity} = (\text{Circumferential length of a circle having the same area as the particle projected area})/(\text{Circumferential length of a particle projected image})$$

The average circularity of the toner can be measured by means of, for example, a flow-type particle image measuring device "FPIA-2100" (manufactured by Sysmex Corporation). The measuring device "FPIA-2100" calculates the circularities of the respective particles. Then, it classifies the particles into each class, which are obtained by equally dividing the circularity range of 0.40 to 1.00 at an interval of 0.01, depending on the calculated circularities. After that, it calculates the average circularity and a standard deviation of circularity, based on the number of measured particles classified into each class and the central value of each class obtained as a result of division.

A specific measurement procedure is as follows. 10 ml of ion-exchanged water from which an impurity solid and the like have been removed in advance are prepared in a vessel. A surfactant (preferably alkylbenzene sulfonate) is added as a dispersant to the ion-exchanged water, and then 0.02 g of a measurement sample is added to and uniformly dispersed into the mixture to prepare a dispersion liquid for measurement. The dispersion can be performed by treating the mixture for 2 minutes by means of an ultrasonic dispersing device "TETORA 150" (manufactured by Nikkaki-Bios Co., Ltd.). At the time of the dispersion treatment, the dispersion liquid is appropriately cooled in order that the temperature of the dispersion liquid may not be 40° C. or higher.

The concentration of the dispersion liquid is adjusted again in such a manner that the toner particle concentration of the dispersion liquid for measurement is in the range of 3,000 to 10,000 particles/μl, and the circularities of 1,000 or more toner particles are measured by means of the flow-type particle image measuring device. To suppress a variation in circularity, the temperature of an environment in which the flow-type particle image measuring device FPIA-2100 is placed is controlled at 23° C.±0.5° C. in such a manner that the temperature inside the device is in the range of 26 to 27° C. Automatic focusing is performed by using a 2-μm latex particle at a predetermined time interval, preferably at an interval of 2 hours.

The average circularity of the toner is determined from a data obtained through discarding data on particles each having a circle-equivalent diameter of less than 2 μm from the result of the measurement.

The measuring device "FPIA-2100", which is used in the present invention, has increased magnification of a processed particle image and increased processing resolution of a captured image (256×256 to 512×512) as compared to a measuring device "FPIA-1000", which has been conventionally used to calculate the shape of toner. Therefore, the measuring device "FPIA-2100" has increased accuracy of toner shape measurement. As a result, the measuring device "FPIA-2100" has achieved more accurate capture of a fine particle. Therefore, in the case where a shape must be measured more accurately as in the present invention, the FPIA-2100 that furnishes more accurate information about the shape is preferably used.

The particle size of the toner of the present invention has only to be an ordinary particle size, and, for example, its weight average particle size (D4) can be set to 3 to 8 μm. The weight average particle size can be determined from the particle size distribution of the toner.

The weight average particle size can be measured with various apparatuses such as a COULTER COUNTER TA-II and a COULTER MULTISIZER (manufactured by Beckman Coulter, Inc). When the COULTER MULTISIZER is used, an interface (manufactured by Nikkaki Bios Co., Ltd.) and a personal computer PC9801 (manufactured by NEC) for outputting a number distribution and a volume distribution are connected to it.

A 1% aqueous solution of NaCl to be used as an electrolyte is prepared by using first-grade sodium chloride. An ISOTON R-II (manufactured by Coulter Scientific Japan, Co.) or the like may be used as electrolyte.

A specific measurement procedure is as follows. 100 to 150 ml of the electrolyte are added with 0.1 to 5 ml of a surfactant (preferably alkylbenzene sulfonate) as a dispersant. Then, 2 to 20 mg of a measurement sample are added to the electrolyte. The electrolyte in which the sample is suspended is subjected to a dispersion treatment by using an ultrasonic dispersing device for about 1 to 3 minutes. After that, by using a COULTER MULTISIZER employing a 100-μm aperture as an aperture, the volume and number of toner are measured to calculate the volume distribution and number distribution of particles each having a particle size of 2 to 40 μm. The weight average particle size (the central value of each channel is defined as a representative value for the channel) is determined from the calculated volume and number distributions.

8. Method of Producing Toner of the Present Invention

The toner of the present invention can be produced by means of a pulverization method, but is preferably produced by means of a polymerization method as described below.

The term "polymerization method" as used herein refers to a method involving: polymerizing a polymerizable monomer in an aqueous medium in the presence of a colorant, a polyester resin, and, as required, other additives (including a releasing agent and a resin except the polyester resin) to produce a binder resin; and directly producing toner simultaneously with the production of the binder resin. Through the polymerization method, localization of a polar component or a nonpolar component/separation between the components are apt to occur by affinity for the aqueous medium. Accordingly, the toner of the present invention can be produced in one step by means of the polymerization method.

In particular, in the production of the toner of the present invention by means of the polymerization method, a polyester resin having an acid value is more preferably used in terms of yield of the toner, because the stability of a droplet during polymerization can be improved and a toner particle size distribution can be made sharp.

The polymerizable monomer can be the same as the monomer described in the description of "4. Binder resin in toner of the present invention."

Examples of polymerization methods to be used for producing the toner of the present invention include an emulsion polymerization method, an association aggregation method, a suspension polymerization method, and a dispersion polymerization method. Also preferably used is a method of producing the toner of the present invention which involves: mixing a binder resin, a colorant, a polyester resin, and, as required, other additives (including a releasing agent) in an organic solvent in which the binder resin is soluble, to prepare an oily component; suspending the oily component into an aqueous medium to turn the component into a particle, to thereby prepare a suspension; and removing the organic solvent from the suspension.

Of those methods, a suspension polymerization method is most preferably used, for example, because: the toner can be produced in an aqueous medium into which the polyester resin can be stably dispersed with ease; particles having a sharp particle size distribution can be easily obtained; and a particle having a uniform surface can be obtained.

A polymerization initiator can be used when the toner of the present invention is produced by means of the polymerization method. A polymerization initiator that can be used preferably has a half life period of 0.5 to 30 hours under polymerization reaction conditions. When a polymerization reaction is performed by adding 0.5 to 20 mass % of such polymerization initiator to a polymerizable monomer, a polymer having a maximum in a molecular weight ranging from 10,000 to 100,000 can be obtained, so a desired strength and appropriate melting property can be imparted to the toner.

Examples of the polymerization initiator include: azo- or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

When the toner of the present invention is produced by means of the polymerization method, a polymerizable monomer can be polymerized in the presence of a dispersion stabilizer. Any one of conventionally known surfactants and organic and inorganic dispersants can be used as the dispersion stabilizer.

Of those, an inorganic dispersant is preferably used because: the dispersant hardly generates undesirable fine powders; its dispersion stability is hardly deteriorated owing to its steric hindrance even when a reaction temperature is changed; the dispersant can be easily washed out; and the dispersant hardly has an adverse effect on the toner. Examples of such inorganic dispersant include: polyvalent metal phosphates such as calcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina.

Those inorganic dispersants are preferably used in a total amount of 0.2 to 20 parts by mass with respect to 100 parts by mass of the polymerizable monomer. Each of those inorganic dispersants is used alone, or two or more of them are used in combination.

When finer toner (having an average particle size of, for example, 5 μm or less) is to be obtained, 0.001 to 0.1 part by mass of a surfactant may be used in combination.

Examples of the surfactant include sodium dodecylbenzenesulfate, sodium tetradecylsulfate, sodium pentadecylsulfate, sodium octylsulfate, sodium oleate, sodium laurate, sodium stearate, and potassium stearate.

When those inorganic dispersants are used, they may be used as they are. On the other hand, when finer particles of the inorganic dispersants are used, the finer particles can be produced in an aqueous medium. For example, water-insoluble calcium phosphate particles can be produced by mixing an aqueous solution of sodium phosphate and an aqueous solution of calcium chloride under high-speed stirring, so the dispersion can be performed more uniformly and more finely. At this time, a water-soluble sodium chloride salt is simultaneously produced as a by-product. The presence of a water-soluble salt in the aqueous medium is more convenient because the dissolution of a polymerizable monomer into the aqueous medium is suppressed and ultrafine toner due to emulsion polymerization is hardly produced. Since the salt becomes an obstacle to the removal of a remaining polymerizable monomer after the completion of polymerization, the aqueous medium is desirably exchanged before the remaining polymerizable monomer is removed, or desalting is desirably performed by means of an ion-exchange resin. The inorganic dispersants can be removed nearly completely by dissolving them by means of an acid or an alkali after the completion of polymerization.

The production of toner by means of a suspension polymerization method involves: appropriately adding, to a polymerizable monomer, a polyester resin and a colorant, and as required, general components of toner (such as a releasing agent, iron oxide, a plasticizer, a binder, a charge control agent, and a cross-linking agent), and other additives (such as an organic solvent for reducing the viscosity of a polymer to be produced through a polymerization reaction and a dispersant); and uniformly dissolving or dispersing the resultant mixture by means of a dispersing device such as a homogenizer, a ball mill, a colloid mill, or an ultrasonic dispersing device to produce a monomer-based composition.

The resultant monomer-based composition is suspended into an aqueous medium containing a dispersion stabilizer. At this time, the particle sizes of toner particles to be obtained can be sharpened by quickly setting the sizes of the suspended particles to desired sizes, by means of a high-speed stirring device or a high-speed dispersing device such as an ultrasonic dispersing device. After the granulation of the suspended particles, stirring has only to be performed by means of an ordinary stirring device to such an extent that the particle states are maintained and the floatation and precipitation of the particles are prevented.

The polymerization initiator may be dissolved into the polymerizable monomer or a solvent, and added: simultaneously with the addition of any other additive to the polymerizable monomer; immediately before the suspension of the monomer-based composition into the aqueous medium; or after the granulation of the suspended particles and before the initiation of a polymerization reaction.

In the production of the toner by means of the suspension polymerization method, a resin except the polyester resin may be added to the polymerizable monomer composition.

Examples of the resin except the polyester resin include the above-described resins each containing a polar functional group. A monomer containing a hydrophilic functional group such as an amino group, a carboxylic acid group, a hydroxyl group, a sulfonic acid group, a glycidyl group, or a nitrile group is dissolved into an aqueous suspension to be subjected to emulsion polymerization, because the monomer has high water-solubility. Therefore, it is not preferable to produce the toner by means of a polymerization method through the addition of a monomer containing the hydrophilic functional group to the polymerizable monomer composition. Accordingly, when toner containing a resin containing a polar functional group is produced by means of a polymerization method, the toner is preferably produced by adding a resin containing a polar functional group (rather than a monomer containing a hydrophilic functional group) to the polymerizable monomer composition.

The amount of the resin containing a polar functional group to be added to the polymerizable monomer composition is preferably 1 to 20 parts by mass with respect to 100 parts by mass of the polymerizable monomer. An amount of less than 1 part by mass makes an effect of the addition of the resin small, while an amount in excess of 20 parts by mass makes it difficult to properly design various physical properties of the polymerized toner.

In the production of the toner by means of the suspension polymerization method, the polymerizable monomer composition can be added with a resin having a molecular weight different from the molecular weight range of a resin obtained by polymerizing the polymerizable monomer (in other words, the "binder resin"). The addition can provide toner having a wide molecular weight distribution and high offset resistance.

In the production of the toner by means of the polymerization method, a cross-linking agent may be added to the polymerizable monomer composition. A preferable amount of the agent to be added is 0.001 to 15 mass % of the polymerizable monomer.

A polymerization reaction temperature in the polymerization step is generally 40° C. or higher, and is preferably set to 50 to 90° C. Performing a polymerization reaction in the temperature range allows a releasing agent, wax, and the like to be included more completely inside toner particle because they are precipitated by phase separation.

The polymerization reaction temperature is preferably increased to be equal to or higher than the temperature at which the peak top of the highest endothermic peak in DSC of the polyester resin added to the polymerizable monomer composition is placed, at the time when the degree of conversion of the polymerizable monomer reaches 50% to 100%.

When toner is produced by means of a polymerization method (preferably a suspension polymerization method), a polyester resin present inside a toner particle is expected to form a domain or be in a finely dispersed state. The polyester resin finely dispersed into the toner can be caused to form a desired domain by increasing a polymerization reaction temperature to be equal to or higher than the melting point of the polyester as described above. The domain diameter of the polyester resin in the toner can also be controlled by adjusting conditions (such as a rate of temperature increase) for increasing the polymerization reaction temperature.

In addition, when the polyester dissolved in the polymerization reaction is not sufficiently crystallized (that is, a degree of crystallinity is low), the degree of crystallinity can be increased by increasing the polymerization reaction temperature to be equal to or higher than the melting point of the polyester. The increasing temperature can allow a lamellar structure to be formed at the surface layer of the toner, so toner which hardly deteriorates or fuses even when it is used for a long time period can be obtained.

After the completion of the polymerization reaction, the toner of the present invention can be produced by filtering out, washing, and drying the resultant particles by means of a conventionally known method. A coarse powder and a fine powder can be removed by performing a classifying step as required.

Furthermore, such external additive as described in the description of the toner can be externally added to the particles (toner particles) obtained by means of the polymerization method by mixing the particles with the external additive. The external addition can be performed by means of an ordinary method. The amount of the external additive to be used is preferably 0.1 to 5 parts by mass (more preferably. 0.1 to 3 parts by mass) with respect to 100 parts by mass of the toner particles.

The toner of the present invention can also be produced by means of a pulverization method. When the toner of the present invention is produced by means of the pulverization method, a method involving multiple steps such as: a step of producing core particles; and a step of adding a polyester resin to the core particle, can be adopted. An example of the method involves: sufficiently mixing, in a mixer such as a Henschel mixer or a ball mill, the binder resin, the colorant, and the polyester resin described above, and, as required, general additives to toner (including a releasing agent and a charge control agent); melting and kneading the resultant mixture by means of a heat kneader such as a heat roll, a kneader, or an extruder; cooling and solidifying the kneaded product; pulverizing the resultant solidified product; and classifying the pulverized product.

The method further involves: performing a surface treatment with the polyester resin to produce toner particles; and, as required, adding/mixing a fine powder and the like to/with the particles. Thus, toner can be produced.

The classification may be performed prior to the surface treatment or vice versa. A multi-division classifier is preferably used in the classifying step in terms of production efficiency.

The pulverizing step can be performed by means of a conventionally known pulverizer such as a mechanical impact type pulverizer or a jet type pulverizer. To obtain toner having a specific circularity, the solidified product is preferably pulverized under heat, or a mechanical impact is preferably applied to the solidified product in an auxiliary manner. A hot water bath method involving dispersing finely pulverized toner particles (classified as required) into hot water, a method involving passing the particles through a heat air current, or the like may be adopted.

An example of a method of applying a mechanical impact includes a method involving the use of a mechanical impact type pulverizer such as a KRYPTRON SYSTEM manufactured by Kawasaki Heavy Industries, Ltd. or a TURBO MILL manufactured by Turbo Kogyo Co., Ltd. Alternatively, a device such as a MECHANOFUSION SYSTEM manufactured by Hosokawa Micron Corp. or a Hybridization SYSTEM manufactured by Nara Machinery Co., Ltd. may be used to press toner against the inside of a casing by means of a blade rotating at a high speed by virtue of a centrifugal force, to thereby apply a mechanical impact to the toner by virtue of a force such as a compressive force or a frictional force.

When a mechanical impact method is used, a thermomechanical impact providing a treatment temperature close to the glass transition point Tg of the toner (Tg±10° C.) is preferable in terms of the prevention of aggregation and the productivity.

9. How to Use Toner of the Present Invention

The toner of the present invention is applicable to an arbitrary image forming apparatus. An example of an image forming apparatus to which the toner is particularly suitably applicable will be described specifically with reference to the accompanying drawings.

Figure 2:
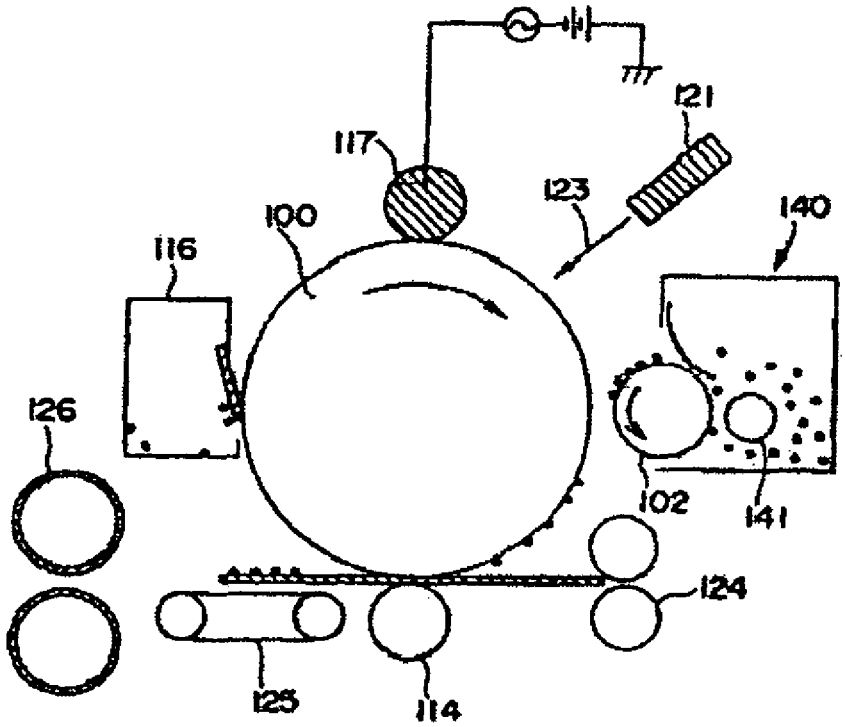
FIG. 2 is a schematic sectional view showing an example of an image forming apparatus using a non-contact development system for which the toner of the present invention can be suitably used.
Figure 3:
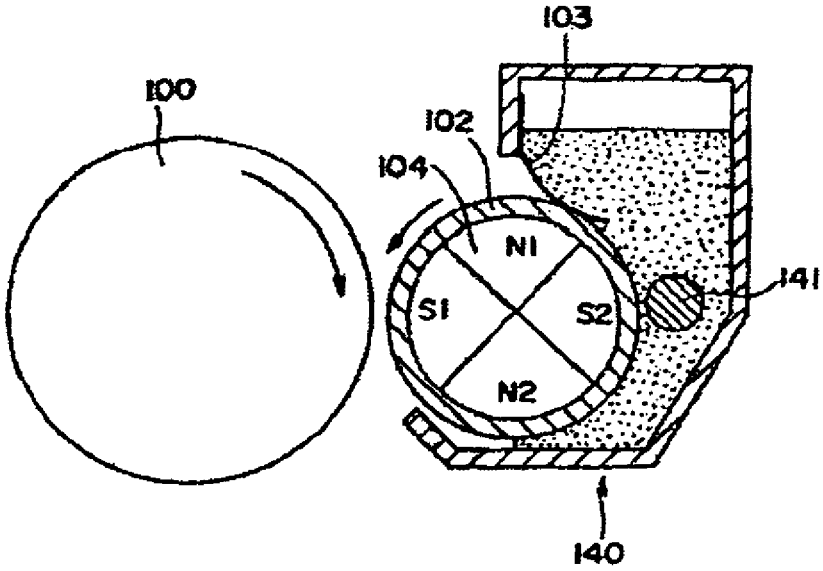
FIG. 3 is an enlarged view showing the structure of a developing device portion in the image forming apparatus shown in FIG. 2.

FIG. 2 is a schematic sectional view showing the structure of the above image forming apparatus, and FIG. 3 is a schematic sectional view showing the structure of a developing device portion shown in FIG. 2. The image forming apparatus shown in the figure is an electrophotographic apparatus adopting a development system using one-component magnetic toner. In the figure, a photosensitive member (electrostatic charge image-bearing member) 100 has a primary charging roller 117, a developing unit 140, a transfer charging roller 114, a cleaner 116, a resister roller 124, and the like around it. The photosensitive member 100 is charged to, for example, −700 V by the primary charging roller 117 (a voltage to be applied is composed of an AC voltage of −2.0 kVpp and a DC voltage of −700 Vdc). Then, the photosensitive member 100 is exposed to light by being irradiated with laser light 123 emitted from a laser generating device 121, so an electrostatic latent image corresponding to an image to be formed is formed on the photosensitive member 100. The electrostatic latent image formed on the photosensitive member 100 is developed by the developing unit 140 with the aid of a one-component magnetic developer, and is transferred onto a transfer material by the roller 114 in contact with the photosensitive member via the transfer material. The transfer material having a toner image mounted thereon is conveyed to a fixing unit 126 by a conveyor belt 125, so the toner image is fixed to the transfer material. The toner partly remaining on the photosensitive member is cleaned by the cleaner 116.

As shown in FIG. 3, the developing unit 140 has a cylindrical toner carrier 102 (hereinafter, referred to as a developing sleeve) made of a non-magnetic metal such as aluminum or stainless steel adjacent to the photosensitive member 100. A gap between the photosensitive member 100 and the developing sleeve 102 is maintained at a predetermined value (for example, about 300 μm) by a sleeve/photosensitive member gap holding member (not shown) or the like. A magnet roller 104 is fixed and arranged in the developing sleeve 102 so as to be concentric with the sleeve, provided that the developing sleeve 102 is rotatable. As shown in the figure, the magnet roller 104 is provided with multiple magnetic poles. A magnetic pole S1 affects development, a magnetic pole N1 affects the regulation of a toner coating amount, a magnetic pole S2 affects the uptake/conveyance of toner, and a magnetic pole N2 affects the prevention of the toner from blowing out. The toner is conveyed by being applied and allowed to adhere to the developing sleeve 102 by a toner applying roller 141. An elastic blade 103 is arranged as a member for regulating the amount of toner to be conveyed. The amount of toner to be conveyed to a developing region is controlled by the pressure at which the elastic blade 103 is in contact with the developing sleeve 102. In the developing region, DC and AC developing biases are applied between the photosensitive member 100 and the developing sleeve 102, so a developer on the developing sleeve flies onto the photosensitive member 100 in accordance with the electrostatic latent image to form a visible image.

An example of an image forming apparatus based on magnetic one-component jumping development has been described here. The toner of the present invention may be magnetic toner or non-magnetic toner. In addition, the toner of the present invention may be one-component toner or toner to be incorporated into a two-component developer. Therefore, the toner of the present invention is applicable to an image forming apparatus adopting any one of magnetic two-component, non-magnetic one-component, and non-magnetic two-component development systems.

The toner of the present invention is also applicable to an image forming apparatus adopting each of a jumping development system and a contact development system.

Hereinafter, the present invention will be described more specifically by way of production examples, examples, and test examples. However, the present invention is not limited to the examples. The term "part" in all the following formulations means "part by mass".

Production of Magnetic Powder 1

An aqueous solution of ferrous sulfate was mixed with 1.0 to 1.1 equivalents of caustic soda with respect to an iron element, 1.5 mass % of soda hexamethaphosphate in terms of a phosphorus element with respect to the iron element, and 1.5 mass % of soda silicate in terms of a silicon element with respect to the iron element, to prepare an aqueous solution containing ferrous hydroxide.

While the pH of the aqueous solution was kept at 8, air was blown to carry out an oxidation reaction at 85° C. to prepare a slurry for producing a seed crystal. Subsequently, the slurry was added with an aqueous solution of ferrous sulfate in an amount of 0.9 to 1.2 equivalents with respect to the initial alkali amount (a sodium component of caustic soda). After that, while the pH of the slurry was kept at 8, air was blown to advance an oxidation reaction to prepare a slurry containing magnetic iron oxide. After the slurry had been filtered and washed, the water-containing sample was once taken out. At this time, a small amount of the water-containing sample was collected to measure a water content.

Next, the resultant water-containing sample was placed into another aqueous medium without being dried, and the whole was stirred. During the stirring, the slurry was sufficiently redispersed by means of a pin mill while being circulated. The pH of the resultant redispersion liquid was adjusted to about 4.8. While the redispersion liquid was sufficiently stirred, 1.5 parts of an n-hexyltrimethoxysilane coupling agent with respect to 100 parts of magnetic iron oxide (the amount of magnetic iron oxide was calculated by subtracting a water content from the water-containing sample) was added to the redispersion liquid to carry out hydrolysis. After that, while stirring was sufficiently performed, the slurry was dispersed by means of a pin mill while being circulated. The pH of the dispersion liquid was set to 8.9 to carry out a condensation reaction, followed by a coupling treatment. The resultant hydrophobic magnetic iron oxide was filtered out with a drum filter. After having been sufficiently washed, the separated solid was dried at 70° C. for 1 hour and at 80° C. for 30 minutes. The resultant particles were crushed to produce a magnetic powder 1 having an average particle size of 0.20 μm.

Production of Polyester Component 1

230.3 parts (1.00 mol) of 1,10-decane dicarboxylic acid, 108.2 parts (1.02 mol) of diethylene glycol, and 0.50 part of tetrabutyl titanate were placed into a reactor equipped with a stirring device, a temperature gauge, and a cooling machine for flowage to carry out an esterification reaction at 190° C. for 5 hours. After that, the temperature was increased to 220° C., and the pressure inside the system was gradually lowered to carry out a polycondensation reaction at 150 Pa for 2 hours. After the pressure had been returned to normal pressure, 24.4 parts (0.20 mol) of benzoic acid were added, and the whole was allowed to react at 220° C. for an additional 2 hours to produce a polyester 1. Table 1 shows the physical properties of the resultant polyester 1.

Production of Polyester Component 2

A polyester 2 was produced in the same manner as in the production of the polyester 1 except that: the amount of tetrabutyl titanate was changed to 0.68 part; and the time for the polycondensation reaction was changed to 1 hour. Table 1 shows the physical properties of the resultant polyester 2.

Production of Polyester Component 3

A polyester 3 was produced in the same manner as in the production of the polyester 1 except that: the amount of tetrabutyl titanate was changed to 0.42 part; and the time for the polycondensation reaction was changed to 3 hours. Table 1 shows the physical properties of the resultant polyester 3.

Production of Polyester Component 4

A polyester 4 was produced in the same manner as in the production of the polyester 1 except that: the amount of tetrabutyl titanate was changed to 0.33 part; and the time for the polycondensation reaction was changed to 5 hours. Table 1 shows the physical properties of the resultant polyester 4.

Production of Polyester Component 5

146.1 parts (1.00 mol) of adipic acid, 108.2 parts (1.02 mol) of diethylene glycol, and 0.50 part of tetrabutyl titanate were placed into a reactor equipped with a stirring device, a temperature gauge, and a cooling machine for flowage to carry out a polycondensation reaction in the same manner as in the production of the polyester 1. After the pressure had been returned to normal pressure, 24.4 parts (0.20 mol) of benzoic acid were added, and the whole was allowed to react at 220° C. for an additional 2 hours to produce a polyester 5. Table 1 shows the physical properties of the resultant polyester 5.

Production of Polyester Component 6

118.1 parts (1.00 mol) of succinic acid, 63.3 parts (1.02 mol) of ethylene glycol, and 0.50 part of tetrabutyl titanate were placed into a reactor equipped with a stirring device, a temperature gauge, and a cooling machine for flowage to carry out a polycondensation reaction in the same manner as in the production of the polyester 1. After the pressure had been returned to normal pressure, 24.4 parts (0.20 mol) of benzoic acid were added, and the whole was allowed to react at 220° C. for an additional 2 hours to produce a polyester 6. Table 1 shows the physical properties of the resultant polyester 6.

Production of Polyester Component 7

118.1 parts (1.00 mol) of succinic acid, 91.9 parts (1.02 mol) of 1,4-butanediol, and 0.50 part of tetrabutyl titanate were placed into a reactor equipped with a stirring device, a temperature gauge, and a cooling machine for flowage to carry out a polycondensation reaction in the same manner as in the production of the polyester 1. After the pressure had been returned to normal pressure, 24.4 parts (0.20 mol) of benzoic acid were added, and the whole was allowed to react at 220° C. for an additional 2 hours to produce a polyester 7. Table 1 shows the physical properties of the resultant polyester 7.

Production of Polyester Component 8

230.3 parts (1.00 mol) of 1,10-decane dicarboxylic acid, 108.2 parts (1.02 mol) of diethylene glycol, and 0.50 part of tetrabutyl titanate were placed into a reactor equipped with a stirring device, a temperature gauge, and a cooling machine for flowage to carry out a polycondensation reaction in the same manner as in the production of the polyester 1. After the pressure had been returned to normal pressure, 24.4 parts (0.20 mol) of benzoic acid and 10.5 parts (0.05 mol) of trimellitic acid were added, and the whole was allowed to react at 220° C. for an additional 2 hours to produce a polyester 8. Table 1 shows the physical properties of the resultant polyester 8.

Production of Polyester Component 9

A polyester 9 was produced in the same manner as in the production of the polyester 8 except that the amount of trimellitic acid was changed to 25.2 parts (0.12 mol). Table 1 shows the physical properties of the resultant polyester 9.

Production of Polyester Component 10

167.1 parts (1.00 mol) of terephthalic acid, 106.2 parts (1.02 mol) of neopentyl glycol, and 0.50 part of tetrabutyl titanate were placed into a reactor equipped with a stirring device, a temperature gauge, and a cooling machine for flowage to carry out a polycondensation reaction in the same manner as in the production of the polyester 1. After the pressure had been returned to normal pressure, 24.4 parts (0.20 mol) of benzoic acid and 10.5 parts (0.05 mol) of trimellitic acid were added, and the whole was allowed to react at 220° C. for an additional 2 hours to produce a polyester 10. Table 1 shows the physical properties of the resultant polyester 10.

Production of Polyester Component 11

182.0 parts (0.90 mol) of sebacic acid, 63.3 parts (1.02 mol) of ethylene glycol, 23.6 parts (0.10 mol) of isophthalic acid-5-sulfonic acid sodium, and 0.50 part of tetrabutyl titanate were placed into a reactor equipped with a stirring device, a temperature gauge, and a cooling machine for flowage to carry out a polycondensation reaction in the same manner as in the production of the polyester 1, thereby producing a polyester 11. Table 1 shows the physical properties of the resultant polyester 11.

TABLE 1

| | Acid component | Alcohol component | Others | Tetrabutyl titanate | Acid value mg/KOH/g | Mn | Tm |
|---|---|---|---|---|---|---|---|
| Polyester Component 1 | 1,10-decane dicarboxylic acid 230.3 parts (1.00 mol) | Diethylene glycol 108.2 parts (1.02 mol) | Benzoic acid 24.4 parts (0.20 mol) | 0.50 part | 0.4 | 3500 | 82° C. |
| Polyester Component 2 | 1,10-decane dicarboxylic acid 230.3 parts (1.00 mol) | Diethylene glycol 108.2 parts (1.02 mol) | Benzoic acid 24.4 parts (0.20 mol) | 0.68 part | 0.5 | 1900 | 86° C. |
| Polyester Component 3 | 1,10-decane dicarboxylic acid 230.3 parts (1.00 mol) | Diethylene glycol 108.2 parts (1.02 mol) | Benzoic acid 24.4 parts (0.20 mol) | 0.42 part | 0.2 | 6400 | 87° C. |
| Polyester Component 4 | 1,10-decane dicarboxylic acid 230.3 parts (1.00 mol) | Diethylene glycol 108.2 parts (1.02 mol) | Benzoic acid 24.4 parts (0.20 mol) | 0.33 part | 0.2 | 10900 | 88° C. |
| Polyester Component 5 | Adipic acid 146.1 parts (1.00 mol) | Diethylene glycol 108.2 parts (1.02 mol) | Benzoic acid 24.4 parts (0.20 mol) | 0.50 part | 0.4 | 3900 | 58° C. |
| Polyester Component 6 | Succinic acid 118.1 parts (1.00 mol) | Ethylene glycol 63.3 parts (1.02 mol) | Benzoic acid 24.4 parts (0.20 mol) | 0.50 part | 0.4 | 4300 | 96° C. |
| Polyester Component 7 | Succinic acid 118.1 parts (1.00 mol) | 1,4-butanediol 91.9 parts (1.02 mol) | Benzoic acid 24.4 parts (0.20 mol) | 0.50 part | 0.4 | 4300 | 114° C. |
| Polyester Component 8 | 1,10-decane dicarboxylic acid 230.3 parts (1.00 mol) | Diethylene glycol 108.2 parts (1.02 mol) | Benzoic acid 24.4 parts (0.20 mol) Trimellitic acid 10.5 parts (0.50 mol) | 0.50 part | 9.4 | 3700 | 87° C. |
| Polyester Component 9 | 1,10-decane dicarboxylic acid 230.3 parts (1.00 mol) | Diethylene glycol 108.2 parts (1.02 mol) | Benzoic acid 24.4 parts (0.20 mol) Trimellitic acid 25.2 parts (0.12 mol) | 0.50 part | 23.6 | 3700 | 89° C. |
| Polyester Component 10 | Terephthalic acid 167.1 parts (1.00 mol) | Neopentyl glycol 106.2 parts (1.02 mol) | Benzoic acid 24.4 parts (0.20 mol) Trimellitic acid 10.5 parts (0.50 mol) | 0.50 part | 11.3 | 300 | 68° C. |
| Polyester Component 11 | Sebacic acid 182.0 parts (0.90 mol) | Ethylene glycol 63.3 parts (1.02 mol) | Isophthalic acid-5-sulfonic acid sodium 23.6 parts (0.10 mol) | 0.50 part | 16.7 | 5200 | 72° C. |

In Table 1, Tm represents the temperature at which a peak top of the highest endothermic peak in DSC measurement is placed.

Production of Sulfonic Acid-Based Polymer 1

Added to a reactor capable of being pressurized equipped with nitrogen-introducing pipe, a dropping device, and a decompression device were 250 parts of methanol, 150 parts of 2-butanone, and 100 parts of 2-propanol as solvents, and 95.0 parts of styrene and S. Oparts of 2-acrylamide-2-methylpropane sulfonic acid as monomers. The resultant mixture was heated to a reflux temperature while being stirred. A solution prepared by diluting 1.5 parts of t-butylperoxy-2-ethylhexanoate as a polymerization initiator with 20 parts of 2-butanone was added dropwise to the heated mixture over 30 minutes, and the whole was stirred for 4 hours. A solution prepared by diluting 0.40 part of t-butylperoxy-2-ethylhexanoate with 20 parts of 2-butanone was added dropwise to the resultant over 30 minutes, and the whole was stirred for an additional 5 hours.

The solvents were distilled off from the resultant mixture to produce a polymer. The resultant polymer was coarsely pulverized by means of a cutter mill equipped with a 100-um screen into pieces each having a size of 100 μm or less, thereby producing a sulfonic acid-based polymer 1 having a weight average molecular weight Mw of 28,000.

EXAMPLE 1

Production of Toner 1

450 parts of a 0.1-mol/l aqueous solution of $Na_3PO_4$ were charged into 720 parts of ion-exchanged water, and the whole was heated to 60° C. After that, 67.7 parts of a 1.0-mol/l aqueous solution of $CaCl_2$ were added to prepare an aqueous medium containing a dispersion stabilizer.

Meanwhile, the following formulations were uniformly dispersed and mixed by means of an ATTRITOR (manufactured by Mitsui Miike Machinery Co., Ltd.). The dispersed mixture was heated to 60° C., and 10 parts of paraffin wax (highest endothermic peak in DSC 78° C., Mn=500, Mw=660) were added to, mixed with, and dissolved into the mixture. 4.5 parts of 2,2'-azobis(2,4-dimethyl-valeronitrile) as a polymerization initiator were dissolved into the resultant to produce a polymerizable monomer composition.

| | |
|---|---|
| Styrene | 74 parts |
| n-butyl acrylate | 26 parts |
| Divinyl benzene | 0.5 part |
| Polyester component 1 | 5 parts |
| Polyester component 8 | 5 parts |
| Negative charge control agent (T-77 (manufactured by Hodogaya Chemical Co., Ltd.)) | 1 part |
| Magnetic powder 1 | 90 parts |

The polymerizable monomer composition was placed into the aqueous medium, and the whole was stirred in an $N_2$ atmosphere at 60° C. by means of a TK HOMOMIXER (manufactured by Tokushu Kika Kogyo Co., Ltd.) at 15,000 rpm for 10 minutes for granulation. After that, the resultant was allowed to react at 70° C. for 5 hours while being stirred by means of a paddle stirring blade. Then, the resultant was heated to 90° C. and stirred in this state for 2 hours. After the completion of the reaction, the suspension was cooled, and was added with hydrochloric acid to dissolve a dispersant. Then, the resultant was filtered, and separated solid was washed with water, and dried to produce toner particles.

1.0 part of a hydrophobic silica fine powder having a BET value of 120 $m^2/g$ obtained by: treating silica having a number average primary particle size of 12 nm with hexamethyldisilazane; and treating the resultant with silicone oil, and 100 parts of the toner particles were mixed by means of a HENSCHEL MIXER (manufactured by Mitsui Miike Machinery Co., Ltd.) to prepare a toner 1.

The cross section of the toner 1 was observed by means of a TEM. As a result, each of the surface layer and inside of the toner was observed to have the lamellar structure of the added polyester. Table 2 shows the physical properties of the toner 1.

EXAMPLE 2

Production of Toner 2

A toner 2 was produced in the same manner as in the production of the toner 1 except that: the polyester component 2 was used instead of the polyester component 1; and the reaction time after the temperature increase up to 90° C. was changed to 30 minutes.

The cross section of the toner 2 was observed by means of a TEM. As a result, each of the surface layer and inside of the toner was observed to have the lamellar structure of the added polyester. Table 2 shows the physical properties of the toner 2.

EXAMPLE 3

Production of Toner 3

A toner 3 was produced in the same manner as in the production of the toner 1 except that the polyester component 3 was used instead of the polyester component 1.

The cross section of the toner 3 was observed by means of a TEM. As a result, each of the surface layer and inside of the toner was observed to have the lamellar structure of the added polyester. Table 2 shows the physical properties of the toner 3.

EXAMPLE 4

Production of Toner 4

A toner 4 was produced in the same manner as in the production of the toner 1 except that: the polyester component 4 was used instead of the polyester component 1; and the reaction time after the temperature increase up to 90° C. was changed to 3 hours.

The cross section of the toner 4 was observed by means of a TEM. As a result, each of the surface layer and inside of the toner was observed to have the lamellar structure of the added polyester. Table 2 shows the physical properties of the toner 4.

EXAMPLE 5

Production of Toner 5

A toner 5 was produced in the same manner as in the production of the toner 1 except that the polyester component 5 was used instead of the polyester component 1.

The cross section of the toner 5 was observed by means of a TEM. As a result, each of the surface layer and inside of the toner was observed to have the lamellar structure of the added polyester. Table 2 shows the physical properties of the toner 5.

EXAMPLE 6

Production of Toner 6

A toner 6 was produced in the same manner as in the production of the toner 1 except that: the polyester component 6 was used instead of the polyester component 1; and, after the granulation, the resultant was allowed to react for 5 hours, and was then heated to 96° C.

The cross section of the toner 6 was observed by means of a TEM. As a result, each of the surface layer and inside of the toner was observed to have the lamellar structure of the added polyester. Table 2 shows the physical properties of the toner 6.

EXAMPLE 7

Production of Toner 7

A toner 7 was produced in the same manner as in the production of the toner 1 except that the polyester component 7 was used instead of the polyester component 1.

The cross section of the toner 7 was observed by means of a TEM. As a result, each of the surface layer and inside of the toner was observed to have the lamellar structure of the added polyester. Table 2 shows the physical properties of the toner 7.

EXAMPLE 8

Production of Toner 8

A toner 8 was produced in the same manner as in the production of the toner 1 except that the polyester component 9 was used instead of the polyester component 8.

The cross section of the toner 8 was observed by means of a TEM. As a result, each of the surface layer and inside of the toner was observed to have the lamellar structure of the added polyester. Table 2 shows the physical properties of the toner 8.

EXAMPLE 9

Production of Toner 9

A toner 9 was produced in the same manner as in the production of the toner 1 except that: the amount of the polyester component 1 added was changed from 5 parts to 2 parts; the amount of the polyester component 8 added was changed from 5 parts to 2 parts; and the amount of the paraffin wax added was changed from 10 parts to 35 parts.

The cross section of the toner 9 was observed by means of a TEM. As a result, each of the surface layer and inside of the toner was observed to have the lamellar structure of the added polyester. Table 2 shows the physical properties of the toner 9.

EXAMPLE 10

Production of Toner 10

A toner 10 was produced in the same manner as in the production of the toner 1 except that the amount of the paraffin wax added was changed from 10 parts to 2 parts.

The cross section of the toner 10 was observed by means of a TEM. As a result, each of the surface layer and inside of the toner was observed to have the lamellar structure of the added polyester. Table 2 shows the physical properties of the toner 10.

EXAMPLE 11

Production of Toner 11

A toner 11 was produced in the same manner as in the production of the toner 1 except that: the amount of the polyester component 1 added was changed from 5 parts to 1 part; and the amount of the polyester component 8 added was changed from 5 parts to 1 part.

The cross section of the toner 11 was observed by means of a TEM. As a result, each of the surface layer and inside of the toner was observed to have the lamellar structure of the added polyester. Table 2 shows the physical properties of the toner 11.

EXAMPLE 12

Production of Toner 12

A toner 12 was produced in the same manner as in the production of the toner 1 except that: the amount of the polyester component 1 added was changed from 5 parts to 16 parts; the amount of the polyester component 8 added was changed from 5 parts to 16 parts; and the amount of the paraffin wax added was changed from 10 parts to 20 parts.

The cross section of the toner 12 was observed by means of a TEM. As a result, each of the surface layer and inside of the toner was observed to have the lamellar structure of the added polyester. Table 2 shows the physical properties of the toner 12.

EXAMPLE 13

Production of Toner 13

A toner 13 was produced in the same manner as in the production of the toner 1 except that no paraffin wax was used.

The cross section of the toner 13 was observed by means of a TEM. As a result, each of the surface layer and inside of the toner was observed to have the lamellar structure of the added polyester. Table 2 shows the physical properties of the toner 13.

EXAMPLE 14

Production of Toner 14

A polymerizable monomer composition was prepared in the same manner as in Example 1 except that no polyester component was used.

The polymerizable monomer composition was placed into the aqueous medium in the same manner as in the production of the toner 1, and the whole was stirred in an $N_2$ atmosphere at 60° C. by means of a TK HOMOMIXER (manufactured by Tokushu Kika Kogyo Co., Ltd.) at 15,000 rpm for 10 minutes for granulation. After that, the resultant was allowed to react at 70° C. for 5 hours while being stirred by means of a paddle stirring blade.

Meanwhile, 150 parts of the polyester component 11 were placed into 850 parts of distilled water, and the whole was mixed and stirred by means of a HOMOGENIZER (manufactured by IKA Japan: Ultratarax) while being heated to 85° C., to thereby prepare a polyester dispersion liquid.

33.3 parts of the polyester dispersion liquid (containing 5 parts of the polyester component 11) were added dropwise to the suspension at 70° C., and the whole was stirred for 3 hours. After that, the resultant was heated to 90° C. and stirred for an additional 2 hours. After the completion of the reaction, the suspension was cooled, and was added with hydrochloric acid to dissolve a dispersant. Then, the resultant was filtered, and a separated solid was washed with water, and dried to produce toner particles.

100 parts of the resultant toner particles and 1.0 part of silica used in the production of the toner 1 were mixed by means of a HENSCHEL MIXER (manufactured by Mitsui Miike Machinery Co., Ltd.) to prepare a toner 14.

The cross section of the toner 14 was observed by means of a TEM. As a result, only the surface layer of the toner was observed to have the lamellar structure of the added polyester. Table 2 shows the physical properties of the toner 14.

EXAMPLE 15

Production of Toner 15

A toner 15 was produced in the same manner as in the production of the toner 1 except that the sulfonic acid-based polymer 1 was used instead of the negative charge control agent (T-77 (manufactured by Hodogaya Chemical Co., Ltd.)).

The cross section of the toner 15 was observed by means of a TEM. As a result, each of the surface layer and inside of the toner was observed to have the lamellar structure of the added polyester. Table 2 shows the physical properties of the toner 15.

COMPARATIVE EXAMPLE 1

Production of Toner 16

A toner 16 was produced in the same manner as in the production of the toner 1 except that none of the polyester components 1 and 8 was used.

The cross section of the toner 16 was observed by means of a TEM. As a result, no region having a lamellar structure was observed. Table 2 shows the physical properties of the toner 16.

COMPARATIVE EXAMPLE 2

Production of Toner 17

A toner 17 was produced in the same manner as in the production of the toner 1 except that: the amount of the polyester component 1 added was changed from 5 parts to 3 parts; and 5 parts of the polyester component 8 were changed to 7 parts of the polyester component 10.

The cross section of the toner 17 was observed by means of a TEM. As a result, no region having a lamellar structure was observed at the surface layer of the toner, and only the inside of the toner was observed to have the lamellar structure of the added polyester. Table 2 shows the physical properties of the toner 17.

COMPARATIVE EXAMPLE 3

Production of Toner 18

After having been sufficiently cooled with liquid nitrogen, each of the polyester component 1 and the polyester component 8 was finely pulverized by means of a SCRAMJET MILL (manufactured by Tokuju Co., Ltd.) into pieces each having a size of 1 μm or less.

Next, the following formulations were mixed by means of a blender, and the resultant mixture was melted and kneaded by means of a biaxial extruder heated to 100° C. The kneaded product was cooled and coarsely pulverized by means of a hammer mill, and the coarsely pulverized product was finely pulverized by means of a jet mill.

The resultant finely pulverized product was subjected to air classification to produce toner particles.

| [Formulations] | |
|---|---|
| Styrene/n-butyl acrylate copolymer (mass ratio 74/26, Mn 5,400, Mw 380,000) | 100 parts |
| Finely pulverized polyester component 1 | 3 parts |
| Finely pulverized polyester component 8 | 3 parts |
| Paraffin wax used in the production of the toner 1 | 10 parts |
| Negative charge control agent (T-77 (manufactured by Hodogaya Chemical Co., Ltd.)) | 1 part |
| Magnetic powder 1 | 90 parts |

100 parts of the resultant toner particles and 1.0 part of silica used in the production of the toner 1 were mixed by means of a HENSCHEL MIXER (manufactured by Mitsui Miike Machinery Co., Ltd.) to prepare toner particles 18.

Meanwhile, 150 parts of the polyester component 11 were placed into 850 parts of distilled water, and the whole was mixed and stirred by means of a HOMOGENIZER (manufactured by IKA Japan: Ultratarax) while being heated to 85° C. to prepare a polyester dispersion liquid. The resultant polyester dispersion liquid was filtered, and a separated solid was dried to produce a polyester fine powder (number average particle size 0.03 elm).

4 parts of the polyester fine powder were externally added to 100 parts of the toner particles 18 thus obtained. The resultant mixture was repeatedly subjected to adherence/coating film formation by means of an impact type surface treatment apparatus (treatment temperature 50° C., peripheral speed of a rotary treating blade 90 m/sec) to produce coated toner particles.

100 parts of the coated toner particles and 1.0 part of silica used in the production of the toner 1 were mixed by means of a HENSCHEL MIXER (manufactured by Mitsui Miike Machinery Co., Ltd.) to prepare a toner 18. The cross section of the toner 18 was observed by means of a TEM. As a result, each of the surface layer and inside of the toner was observed to have the lamellar structure of the added polyester fine powder. Table 2 shows the physical properties of the toner 18.

COMPARATIVE EXAMPLE 4

Production of Toner 19

Toner particles were prepared in the same manner as in the production of the toner 1 except that: the amount of the polyester component 1 added was changed from 5 parts to 10 parts; and the polyester component 8 was not used.

25 parts of emulsified particles (styrene-methacrylic acid copolymer (polymerization ratio 95/5), number average particle size 0.05 μm) were externally added to 100 parts of the toner particles. The resultant mixture was repeatedly subjected to adherence/coating film formation by means of an impact type surface treatment apparatus (treatment temperature 50° C., peripheral speed of a rotary treating blade 90 m/sec) to produce coated toner particles.

100 parts of the coated toner particles and 1.0 part of silica used in the production of the toner 1 were mixed by means of a HENSCHEL MIXER (manufactured by Mitsui Miike Machinery Co., Ltd.) to prepare a toner 19. The cross section of the toner 19 was observed by means of a TEM. As a result, no region having a lamellar structure was observed at the surface layer of the toner, and only the inside of the toner was observed to have the lamellar structure of the added polyester. Table 2 shows the physical properties of the toner 19.

COMPARATIVE EXAMPLE 5

Production of Toner 20

After having been sufficiently cooled with liquid nitrogen, each of the polyester component 1 and the polyester component 8 was finely pulverized by means of a SCRAMJET MILL (manufactured by Tokuju Co., Ltd.) into pieces each having a size of 1 μm or less.

Next, the following formulations were mixed by means of a blender, and the resultant mixture was melted and kneaded by means of a biaxial extruder heated to 150° C. The kneaded product was cooled and coarsely pulverized by means of a hammer mill, and the coarsely pulverized product was finely pulverized by means of a jet mill. The resultant finely pulverized product was subjected to air classification to produce toner particles. 100 parts of the toner particles and 1.0 part of silica used in the production of the toner 1 were mixed by means of a HENSCHEL MIXER (manufactured by Mitsui Miike Machinery Co., Ltd.) to prepare a toner 20.

| [Formulations] | |
|---|---|
| Styrene/n-butyl acrylate copolymer (mass ratio - 74/26, Mn 5,400, Mw 380,000) | 100 parts |
| Finely pulverized polyester component 1 | 5 parts |
| Finely pulverized polyester component 8 | 5 parts |
| Paraffin wax used in the production of the toner 1 | 10 parts |
| Negative charge control agent (T-77 (manufactured by Hodogaya Chemical Co., Ltd.)) | 1 part |
| Magnetic powder 1 | 90 parts |

The cross section of the toner 20 was observed by means of a TEM. As a result, no region having a lamellar structure was observed. Table 2 shows the physical properties of the toner 20.

used in the production of the toner 1 were added to, mixed with, and dissolved into the mixture. 6.5 parts of 2,2'-azobis (2,4-dimethylvaleronitrile) as a polymerization initiator were dissolved into the resultant to produce a polymerizable monomer composition.

| [Formulations] | |
|---|---|
| Styrene | 74 parts |
| n-butyl acrylate | 26 parts |
| C.I. Pigment Blue 15:3 | 7 parts |
| Aluminum 3,5-di-t-butyl-salicylate compound | 1 part |
| Divinyl benzene | 0.45 part |
| Polyester component 1 | 5 parts |
| Polyester component 8 | 5 parts |

The polymerizable monomer composition was placed into the aqueous medium, and the whole was stirred in an $N_2$ atmosphere at 60° C. by means of a TK Homomixer at 12,000 rpm for granulation. After that, the resultant was allowed to react at 70° C. for 5 hours while being stirred by means of a paddle stirring blade. Then, the resultant was heated to 90° C. and stirred in this state for 2 hours. After the completion of the reaction, the suspension was cooled, and was added with hydrochloric acid for washing. Then, the resultant was filtered, and a separated solid was washed with water, dried, and classified to produce cyan toner particles with their particle sizes adjusted.

TABLE 2

| | Toner | Polyester Resin | Weight Average particle size (μm) | Average circularity | Domain diameter (μm) | Wc/Pc |
|---|---|---|---|---|---|---|
| Example 1 | 1 | 1 (5 parts)/8 (5 parts) | 6.2 | 0.973 | 1.4 | 1.0 |
| Example 2 | 2 | 2 (5 parts)/8 (5 parts) | 6.0 | 0.974 | 0.2 | 1.0 |
| Example 3 | 3 | 3 (5 parts)/8 (5 parts) | 6.4 | 0.971 | 2.3 | 1.0 |
| Example 4 | 4 | 4 (5 parts)/8 (5 parts) | 6.8 | 0.967 | 3.2 | 1.0 |
| Example 5 | 5 | 5 (5 parts)/8 (5 parts) | 6.3 | 0.975 | 1.2 | 1.0 |
| Example 6 | 6 | 6 (5 parts)/8 (5 parts) | 6.9 | 0.971 | 1.6 | 1.0 |
| Example 7 | 7 | 7 (5 parts)/8 (5 parts) | 7.4 | 0.965 | 1.8 | 1.0 |
| Example 8 | 8 | 1 (5 parts)/9 (5 parts) | 6.5 | 0.975 | 1.3 | 1.0 |
| Example 9 | 9 | 1 (2 parts)/8 (2 parts) | 6.3 | 0.970 | 0.8 | 8.8 |
| Example 10 | 10 | 1 (5 parts)/8 (5 parts) | 6.6 | 0.966 | 1.4 | 0.2 |
| Example 11 | 11 | 1 (1 parts)/8 (5 parts) | 6.1 | 0.976 | 0.6 | 5.0 |
| Example 12 | 12 | 1 (16 parts)/8 (16 parts) | 7.1 | 0.975 | 2.1 | 0.6 |
| Example 13 | 13 | 1 (5 parts)/8 (5 parts) | 6.1 | 0.974 | 1.5 | 0 |
| Example 14 | 14 | 11 (5 parts) | 6.7 | 0.972 | — | 2.0 |
| Example 15 | 15 | 1 (5 parts)/8 (5 parts) | 6.5 | 0.975 | 1.4 | 1.0 |
| Comparative Example 1 | 16 | — | 6.5 | 0.976 | — | — |
| Comparative Example 2 | 17 | 1 (3 parts)/10 (7 parts) | 6.4 | 0.970 | 1.1 | 3.3 |
| Comparative Example 3 | 18 | 1 (3 parts)/8 (3 parts) 11 (4 parts) | 6.6 | 0.938 | 0.7 | 1.0 |
| Comparative Example 4 | 19 | 1 (10 parts) | 6.0 | 0.965 | 1.8 | 1.0 |
| Comparative Example 5 | 20 | 1 (5 parts)/8 (5 parts) | 6.1 | 0.935 | — | 1.0 |

EXAMPLE 16

Production of Cyan Toner 500 parts of a 0.1-mol/l aqueous solution of $Na_3PO_4$ were charged into 720 parts by mass of ion-exchanged water, and the whole was heated to 60° C. After that, 72 parts by mass of a 1.0-mol/l aqueous solution of $CaCl_2$ were added to prepare an aqueous medium containing a dispersion stabilizer.

Meanwhile, the following formulations were uniformly dispersed and mixed by means of an ATTRITOR (manufactured by Mitsui Miike Machinery Co., Ltd.). The dispersed mixture was heated to 60° C., and 10 parts of the paraffin wax 100 parts of the cyan toner particles were mixed with 0.2 part by mass of titanium oxide (number average primary particle size: 45 nm) and 1.5 parts of silica used in the production of the toner 1 by means of a HENSCHEL MIXER (manufactured by Mitsui Miike Machinery Co., Ltd.) to prepare a cyan toner. Table 3 shows the physical properties of the cyan toner.

EXAMPLE 17

Production of Magenta Toner

A magenta toner was produced in the same manner as in the production of the cyan toner except that 8 parts by mass of quinacridone (C.I. Pigment Red 122) were used instead of C.I. Pigment Blue 15:3. Table 3 shows the physical properties of the magenta toner.

EXAMPLE 18

Production of Yellow Toner

A yellow toner was produced in the same manner as in the production of the cyan toner except that 6.5 parts of Pigment Yellow 93 were used instead of C. I. Pigment Blue 15:3. Table 3 shows the physical properties of the yellow toner.

EXAMPLE 19

Production of Black Toner

A black toner was produced in the same manner as in the production of the cyan toner except that 5 parts by mass of carbon black (PRINTEX 35, manufactured by Degussa) were used instead of C.I. Pigment Blue 15:3. Table 3 shows the physical properties of the black toner.

TABLE 3

| | Polyester resin | Weight average particle size (μm) | Average circularity | Domain diameter (μm) | Wc/Pc |
|---|---|---|---|---|---|
| Cyan toner | 1 (5 parts)/ 8 (5 parts) | 7.0 | 0.971 | 1.3 | 1.0 |
| Magenta toner | 1 (5 parts)/ 8 (5 parts) | 6.8 | 0.973 | 1.2 | 1.0 |
| Yellow toner | 1 (5 parts)/ 8 (5 parts) | 7.0 | 0.969 | 1.4 | 1.0 |
| Black toner | 1 (5 parts)/ 8 (5 parts | 6.9 | 0.973 | 1.6 | 1.0 |

TEST EXAMPLES 1 TO 15 AND COMPARATIVE TEST EXAMPLES 1 TO 5

The following tests were performed on each of the toners 1 to 20 produced in Examples 1 to 15 and Comparative Examples 1 to 5, and various items were measured and evaluated.

Image Output Test

In a normal-temperature-and-normal-humidity environment (23° C., 60% RH), a 10,000-sheet image output test was performed by means of the following image forming apparatus with an image pattern using an 8-point letter "A" and having a printing ratio of 4% in an intermittent mode. A4 paper of 75 g/m$^2$ was used as a transfer material.

The image forming apparatus adopted in the image output test was obtained by reconstructing a LASER JET4300 (manufactured by Hewlett-Packard Development Company, L.P.) with regard to the following points. FIGS. 2 and 3 each schematically show the structure of the reconstructed apparatus.

An electrostatic charge image-bearing member (photosensitive drum) was allowed to have a dark area potential Vo=−650 V and a light area potential VL=−130 V.

A gap between the electrostatic charge image-bearing member and a developing sleeve was set to 270 μm.

Used as a toner carrier was a developing sleeve obtained by forming, on an aluminum cylinder of 16 mm in diameter having a blasted surface, a resin layer with the following composition having a layer thickness of about 7 μm and a JIS center line average roughness (Ra) of 1.0 μm.

| [Composition of resin layer] | |
|---|---|
| Phenol resin Carbon black | 100 parts by mass |
| Graphite (particle size about 7 μm) | 90 parts by mass |
| Carbon black | 10 parts by mass |

The magnetic flux density of a magnetic field formed by a developing magnetic pole was set to 85 mT (850 gauss).

A urethane blade having a thickness of 1.0 mm and a free length of 0.5 mm was used as a toner regulating member, and was brought into abutment with the toner carrier at a linear pressure of 39.2 N/m (40 g/cm).

A developing bias having a DC bias component $V_{dc}$=−450 V and a superimposing AC bias component $V_{p-p}$=1, 600 V with a frequency f=2,200 Hz was used.

The developing sleeve was rotated in a forward direction at an opposing portion relative to the rotation of the photosensitive member at a speed (292 mm/sec) equal to 110% of the peripheral speed of the photosensitive member (265 mm/sec).

A transferring bias was +1.5 kV DC.

Solid images were formed at an initial stage (100th sheet) of the image output test and after the image output on 10,000 sheets in the test (after duration). The image densities of the solid images were measured by means of a MACBETH REFLECTION DENSITOMETER (manufactured by Macbeth). Table 4 shows the results.

White images were output at an initial stage of the image output test and after the image output on 10,000 sheets in the test (after duration). The reflectivities of the output images (sample images) were measured by means of a REFLECTMETER MODEL TC-6DS manufactured by Tokyo Denshoku. A green filter was used as a filter. The reflectivity of standard paper was similarly measured as contrast. Fogging was calculated from the following expression.

Fogging (%)=Reflectivity of standard paper (%)−Reflectivity of sample image (%)

The calculated fogging was evaluated according to the following criteria. Table 4 shows the results.

A: Very good (less than 1.5%)

B: Good (1.5% or more and less than 2.5%)

C: Normal (2.5% or more and less than 4.0%)

D: Bad (4.0% or more)

Whether toner fusion occurred on the toner carrier after the duration in the image output test was visually observed, and was evaluated according to the following criteria. Table 4 shows the results.

A: No fusion occurs.

B: Fusion slightly occurs, but causes no problem in practical use because it does not appear on an image.

C: Fusion occurs, and a streak occurs on an image.

<Fixing Test>

The same apparatus as the image forming apparatus used in the image output test was used. The set temperature (fixing temperature) of a fixing unit was increased from 130° C. to 230° C. in an increment of 5° C. A half tone image was formed on a FOX RIVER BOND PAPER (manufactured by FOX RIVER, 90 g/m$^2$) at each fixing temperature in such a manner that the image would have an image density of 0.80 to 0.85, thereby producing a fixed image.

The image obtained at each fixing temperature was rubbed with lens-cleaning paper 10 times with a load of 4.9 kPa (50 g/cm$^2$) applied to the paper. The fixing temperature at which a rate of reduction in density before and after the rubbing was 10% or less was determined and defined as a fixation starting temperature. Table 4 shows the results.

<Offset Test>

The same apparatus as the image forming apparatus used in the image output test was used. The set temperature (fixing temperature) of a fixing unit was increased from 130° C. to 230° C. in an increment of 5° C. A solid image was formed on A4 paper of 75 g/m$^2$ at each fixing temperature in such a manner that a toner amount per unit area would be 0.6 mg/cm$^2$. The formed solid image was observed to examine the temperature (hot offset temperature) at which a hot offset phenomenon occurred. The presence or absence of the occurrence of a hot offset phenomenon was judged by visually observing contamination on an image or on the rear surface of the paper. Table 4 shows the results.

<Storage Stability Test>

A toner was evaluated for storage stability according to the following criteria.

After 10 g of a toner had been left in an environment at 50° C. for 72 hours, the toner was evaluated for storage stability according to the following criteria. Table 4 shows the results.

A: Toner is good because of its excellent fluidity.

B: Toner has an aggregate which is readily loosened.

C: Toner has an aggregates which is slightly loosened.

D: Toner has no fluidity, or generates caking.

TABLE 4

| | | Initial stage | | After duration | | Toner | Storage | Fixation starting | Hot offset temperature |
|---|---|---|---|---|---|---|---|---|---|
| | Toner | Density | Fogging | Density | Fogging | fusion | stability | temperature (° C.) | (° C.) |
| Test Example 1 | 1 | 1.50 | A | 1.48 | A | A | A | 140 | 230 |
| Test Example 2 | 2 | 1.46 | A | 1.40 | B | B | B | 130 | 225 |
| Test Example 3 | 3 | 1.45 | A | 1.41 | A | A | A | 150 | 230 |
| Test Example 4 | 4 | 1.50 | B | 1.49 | B | A | A | 155 | 230 |
| Test Example 5 | 5 | 1.43 | A | 1.38 | B | B | B | 150 | 215 |
| Test Example 6 | 6 | 1.47 | B | 1.42 | B | A | A | 155 | 230 |
| Test Example 7 | 7 | 1.45 | B | 1.32 | C | A | A | 160 | 230 |
| Test Example 8 | 8 | 1.39 | B | 1.30 | C | B | B | 145 | 225 |
| Test Example 9 | 9 | 1.41 | B | 1.36 | C | B | C | 130 | >230 |
| Test Example 10 | 10 | 1.53 | A | 1.51 | A | A | A | 155 | 215 |
| Test Example 11 | 11 | 1.51 | A | 1.41 | B | B | C | 160 | 220 |
| Test Example 12 | 12 | 1.44 | B | 1.39 | C | B | A | 150 | >230 |
| Test Example 13 | 13 | 1.49 | A | 1.47 | A | A | A | 175 | 225 |
| Test Example 14 | 14 | 1.46 | A | 1.43 | A | A | A | 165 | 230 |
| Test Example 15 | 15 | 1.52 | A | 1.51 | A | A | A | 145 | 230 |
| Comparative Test Example 1 | 16 | 1.45 | B | 1.25 | D | C | D | 180 | 220 |
| Comparative Test Example 2 | 17 | 1.47 | A | 1.35 | B | B | C | 145 | 225 |
| Comparative Test Example 3 | 18 | 1.45 | B | 1.39 | B | B | B | 155 | 215 |
| Comparative Test Example 4 | 19 | 1.37 | B | 1.18 | C | B | B | 155 | 230 |
| Comparative Test Example 5 | 20 | 1.32 | C | 1.15 | D | C | D | 135 | 195 |
| Test Example 1 | 1 | 1.50 | A | 1.48 | A | A | A | 140 | 230 |
| Test Example 2 | 2 | 1.46 | A | 1.40 | B | B | B | 130 | 225 |
| Test Example 3 | 3 | 1.45 | A | 1.41 | A | A | A | 150 | 230 |
| Test Example 4 | 4 | 1.50 | B | 1.49 | B | A | A | 155 | 230 |
| Test Example 5 | 5 | 1.43 | A | 1.38 | B | B | B | 150 | 215 |
| Test Example 6 | 6 | 1.47 | B | 1.42 | B | A | A | 155 | 230 |
| Test Example 7 | 7 | 1.45 | B | 1.32 | C | A | A | 160 | 230 |
| Test Example 8 | 8 | 1.39 | B | 1.30 | C | B | B | 145 | 225 |
| Test Example 9 | 9 | 1.41 | B | 1.36 | C | B | C | 130 | >230 |
| Test Example 10 | 10 | 1.53 | A | 1.51 | A | A | A | 155 | 215 |
| Test Example 11 | 11 | 1.51 | A | 1.41 | B | B | C | 160 | 220 |
| Test Example 12 | 12 | 1.44 | B | 1.39 | C | B | A | 150 | >230 |
| Test Example 13 | 13 | 1.49 | A | 1.47 | A | A | A | 175 | 225 |
| Test Example 14 | 14 | 1.46 | A | 1.43 | A | A | A | 165 | 230 |
| Test Example 15 | 15 | 1.52 | A | 1.51 | A | A | A | 145 | 230 |
| Comparative Test Example 1 | 16 | 1.45 | B | 1.25 | D | C | D | 180 | 220 |
| Comparative Test Example 2 | 17 | 1.47 | A | 1.35 | B | B | C | 145 | 225 |
| Comparative Test Example 3 | 18 | 1.45 | B | 1.39 | B | B | B | 155 | 215 |
| Comparative Test Example 4 | 19 | 1.37 | B | 1.18 | C | B | B | 155 | 230 |
| Comparative Test Example 5 | 20 | 1.32 | C | 1.15 | D | C | D | 135 | 195 |

As shown in Table 4, it has been found that, when the toner 1 is used, a good image having: a small reduction in image density after the duration in the image output test as compared to the initial stage of the test; and suppressed fogging, can be obtained.

When each of the toners 2 to 15 is used, the properties of an image at an initial stage of the image output test have no problems, and an image after the duration has no large problems.

It has been found that, when each of the toners 16 to 19 (each having no lamellar structure at its surface layer) is used, an image density reduces as the duration in the image output test proceeds. It has been also found that, in particular, when the toner 16 or 19 is used, fogging is remarkable.

It has been found that the toner 16 (containing no polyester resin) provides a narrow fixing region.

TEST EXAMPLE 16

The following tests were performed on each of the four color toners produced in Examples 16 to 19, and various items were evaluated.

<Image Output Test>

In a normal-temperature-and-normal-humidity environment, an 8,000-sheet image output test was performed by means of a reconstructed apparatus obtained by setting the process speed of an LBP-2510 (manufactured by Canon) employing a contact development system to 150 mm/sec.

The density and fogging at an initial stage or after duration, and toner fusion to a toner carrier were measured or evaluated in the same manner as in the image output test in Test Example 1. Table 5 shows the results.

<Storage Stability Test>

Each of the four color toners produced in Examples 16 to 19 was evaluated for stability in the same manner as in the storage stability test in Test Example 1. Table 5 shows the results.

<Fixing Test>

The same apparatus as that used in the image output test was used. The temperature (fixing temperature) of a fixing unit was adjusted, and a solid image was formed by means of each of the four color toners produced in Examples 16 to 19 on a CLC copier paper (80 g/cm$^2$) in such a manner that a toner weight per unit area would be 0.6 mg/cm$^2$, thereby producing a fixed image. The surface gloss of the solid image obtained at each fixing temperature was measured by means of a Gardner Microgloss 75°, and the fixing temperature at which the measured value exceeded 15 was determined. As a result, each toner had a gloss in excess of 15 at 160° C. and caused no offset. That is, each toner showed good low-temperature fixability.

TABLE 5

| | Initial stage | | After duration | | Toner | Storage |
|---|---|---|---|---|---|---|
| Toner | Density | Fogging | Density | Fogging | fusion | stability |
| Cyan toner | 1.47 | A | 1.44 | A | A | A |
| Magenta toner | 1.45 | A | 1.44 | A | A | A |
| Yellow toner | 1.48 | A | 1.45 | A | A | A |

TABLE 5-continued

| | Initial stage | | After duration | | Toner | Storage |
|---|---|---|---|---|---|---|
| Toner | Density | Fogging | Density | Fogging | fusion | stability |
| Black toner | 1.49 | A | 1.45 | A | A | A |

As shown in Table 5, the use of each toner provided an image having high densities at an initial stage of the image output test and after the duration in the test, and having no fogging, and no fusion to a toner carrier occurred.

This application claims priority from Japanese Patent Application No. 2004-265663 filed Sep. 13, 2004, which is hereby incorporated by reference herein.

What is claimed is:

1. A toner comprising: a binder resin, a colorant, a releasing agent and a polyester resin, the toner having an average circularity of 0.950 or more, wherein:

(a) the polyester resin contains at least, as a main component, a crystalline polyester component obtained by subjecting a monomer composition containing, as main components, an alcohol selected from aliphatic diols each having 2 to 22 carbon atoms and a carboxylic acid selected from aliphatic dicarboxylic acids each having 2 to 22 carbon atoms to a polycondensation reaction; and (b) a region having a lamellar structure formed of the crystalline polyester component and present at a surface layer of the toner, wherein a ratio (Wc/Pc) of a content mass (Wc) of the releasing agent to a content mass (Pc) of the crystalline polyester component is 0.5 to 8.0.

2. A toner according to claim 1, wherein a region having a lamellar structure is present also inside the toner.

3. A toner according to claim 2, wherein the lamellar structure is formed of the crystalline polyester component.

4. A toner according to claim 1, wherein a domain of the polyester resin having a diameter of 0.3 to 3.0 m is present inside the toner.

5. A toner according to claim 1, wherein the ratio (Wc/Pc) is 0.5 to 4.0.

6. A toner according to claim 1, wherein a peak top of a highest endothermic peak in differential scanning calorimetry (DSC) of the crystalline polyester component is placed at a temperature of 60° C. to 110° C.

7. A toner according to claim 6, wherein the peak top of the highest endothermic peak is placed at a temperature of 70° C. to 90° C.

8. A toner according to claim 1, wherein the crystalline polyester component has a number average molecular weight of 2,000 to 10,000.

9. A toner according to claim 8, wherein the crystalline polyester component has a number average molecular weight of 2,000 to 6,000.

10. A toner according to claim 1, comprising 3 to 30 parts by mass of the crystalline polyester component to 100 parts by mass of the binder resin.

11. A toner according to claim 1, comprising a polymer having one of a sulfonic acid group, a sulfonic acid salt group, and a sulfonic ester group.

* * * * *